US010136485B1

(12) United States Patent
Coetzee et al.

(10) Patent No.: US 10,136,485 B1
(45) Date of Patent: Nov. 20, 2018

(54) METHODS FOR ADJUSTING THE LIGHT OUTPUT OF ILLUMINATION SYSTEMS

(71) Applicants: William P. Coetzee, Coquitlam (CA); Paul Jungwirth, Burnaby (CA); Michael A. Tischler, Vancouver (CA)

(72) Inventors: William P. Coetzee, Coquitlam (CA); Paul Jungwirth, Burnaby (CA); Michael A. Tischler, Vancouver (CA)

(73) Assignee: COOLEDGE LIGHTING INC., Richmond (CA)

( * ) Notice: Subject to any disclaimer, the term of this patent is extended or adjusted under 35 U.S.C. 154(b) by 0 days.

(21) Appl. No.: 15/473,798

(22) Filed: Mar. 30, 2017

Related U.S. Application Data

(60) Provisional application No. 62/315,112, filed on Mar. 30, 2016.

(51) Int. Cl.
*H05B 33/08* (2006.01)
*H05B 37/02* (2006.01)

(52) U.S. Cl.
CPC ..... *H05B 33/0827* (2013.01); *H05B 33/0815* (2013.01); *H05B 33/0842* (2013.01); *H05B 33/0845* (2013.01); *H05B 37/0281* (2013.01)

(58) Field of Classification Search
CPC ..... H05B 33/0815; H05B 33/0803; H05B 33/0821; H05B 33/0818; H05B 33/0809; H05B 33/0824; H05B 33/0827; H05B 33/0857; H05B 33/083; H05B 37/029; H05B 33/08; H05B 33/0845; H05B 33/0851; H05B 33/0872; H05B 37/02; H05B 37/0272; H05B 1/0294; H05B 33/02; H05B 33/0806; H05B 33/0848; H05B 33/0854; H05B 33/0863; H05B 33/0866; H05B 33/0884; H05B 33/0893; H05B 37/0227; H05B 39/08; H05B 41/16; H05B 41/3927
See application file for complete search history.

(56) References Cited

U.S. PATENT DOCUMENTS

| | | | | |
|---|---|---|---|---|
| 8,810,141 | B2 * | 8/2014 | Takeda | H05B 33/0818 315/192 |
| 9,402,288 | B2 * | 7/2016 | Xu | G09G 3/34 |
| 2003/0043611 | A1 * | 3/2003 | Bockle | H05B 33/0815 363/131 |
| 2007/0080652 | A1 * | 4/2007 | Elferich | H05B 33/0818 315/291 |
| 2008/0211421 | A1 * | 9/2008 | Lee | H05B 33/0806 315/250 |
| 2009/0021175 | A1 * | 1/2009 | Wendt | H02M 3/3376 315/200 R |
| 2010/0066258 | A1 * | 3/2010 | Yasuda | H05B 33/0803 315/186 |
| 2010/0079085 | A1 * | 4/2010 | Wendt | H05B 33/0815 315/294 |

(Continued)

*Primary Examiner* — Tung X Le
*Assistant Examiner* — Borna Alaeddini
(74) *Attorney, Agent, or Firm* — Morgan, Lewis & Bockius LLP

(57) ABSTRACT

In accordance with various embodiments, an overall optical characteristic of light emitted by an illumination system having multiple strings of light-emitting elements, as well as an overall intensity of the light emitted by the illumination system, are independently selected via controlling the strings over multiple time intervals.

18 Claims, 17 Drawing Sheets

(56) References Cited

U.S. PATENT DOCUMENTS

| | | | | |
|---|---|---|---|---|
| 2010/0320934 | A1* | 12/2010 | Liu | H02M 1/4258 315/294 |
| 2012/0280635 | A1* | 11/2012 | Lu | H05B 33/0809 315/250 |
| 2012/0286683 | A1* | 11/2012 | Radermacher | H05B 33/0815 315/201 |
| 2014/0361697 | A1* | 12/2014 | Miskin | H05B 33/0821 315/192 |
| 2014/0368125 | A1* | 12/2014 | Stack | H05B 33/0821 315/251 |
| 2016/0205739 | A1* | 7/2016 | Grajcar | H05B 33/0845 315/210 |

* cited by examiner

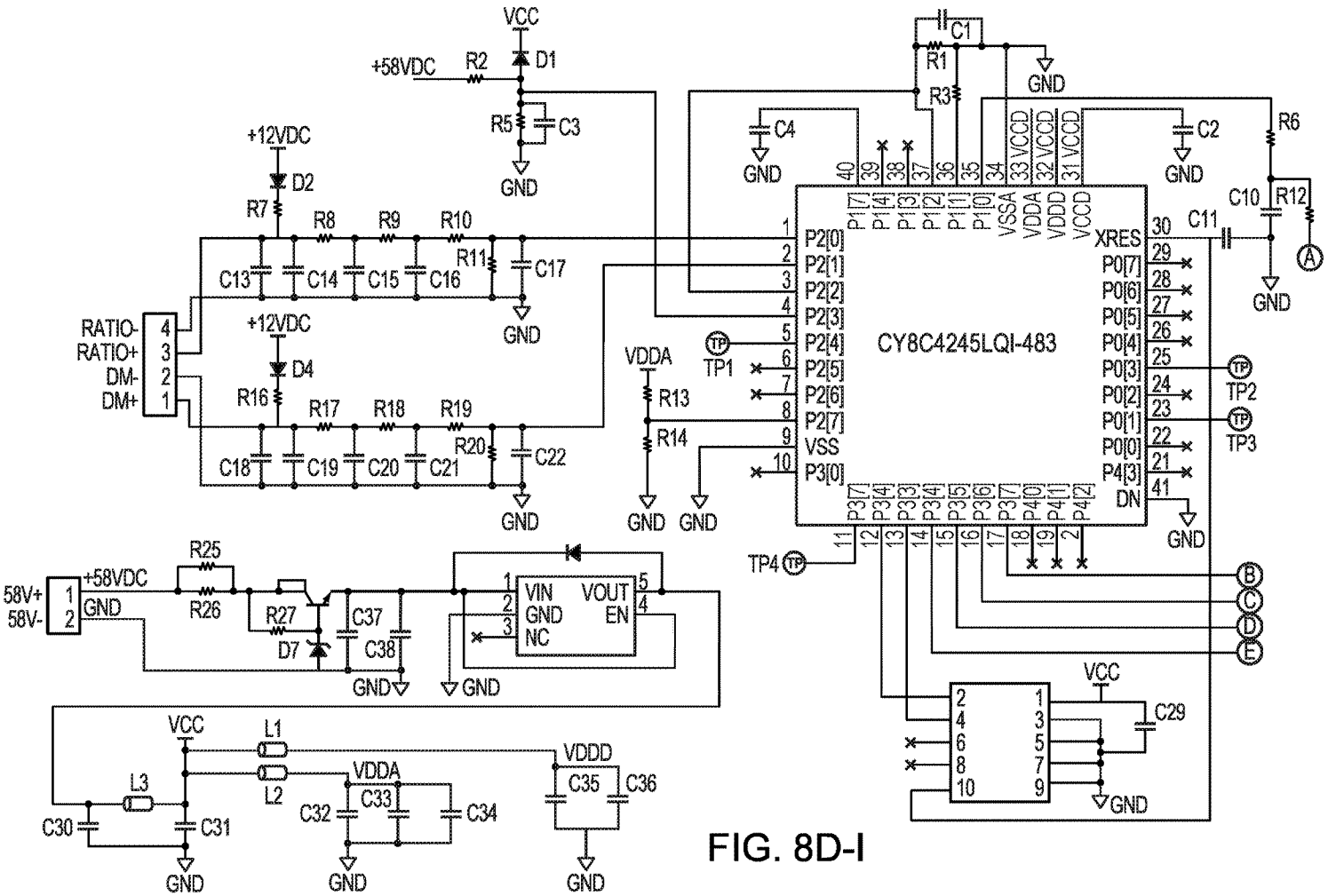
FIG. 8D-I

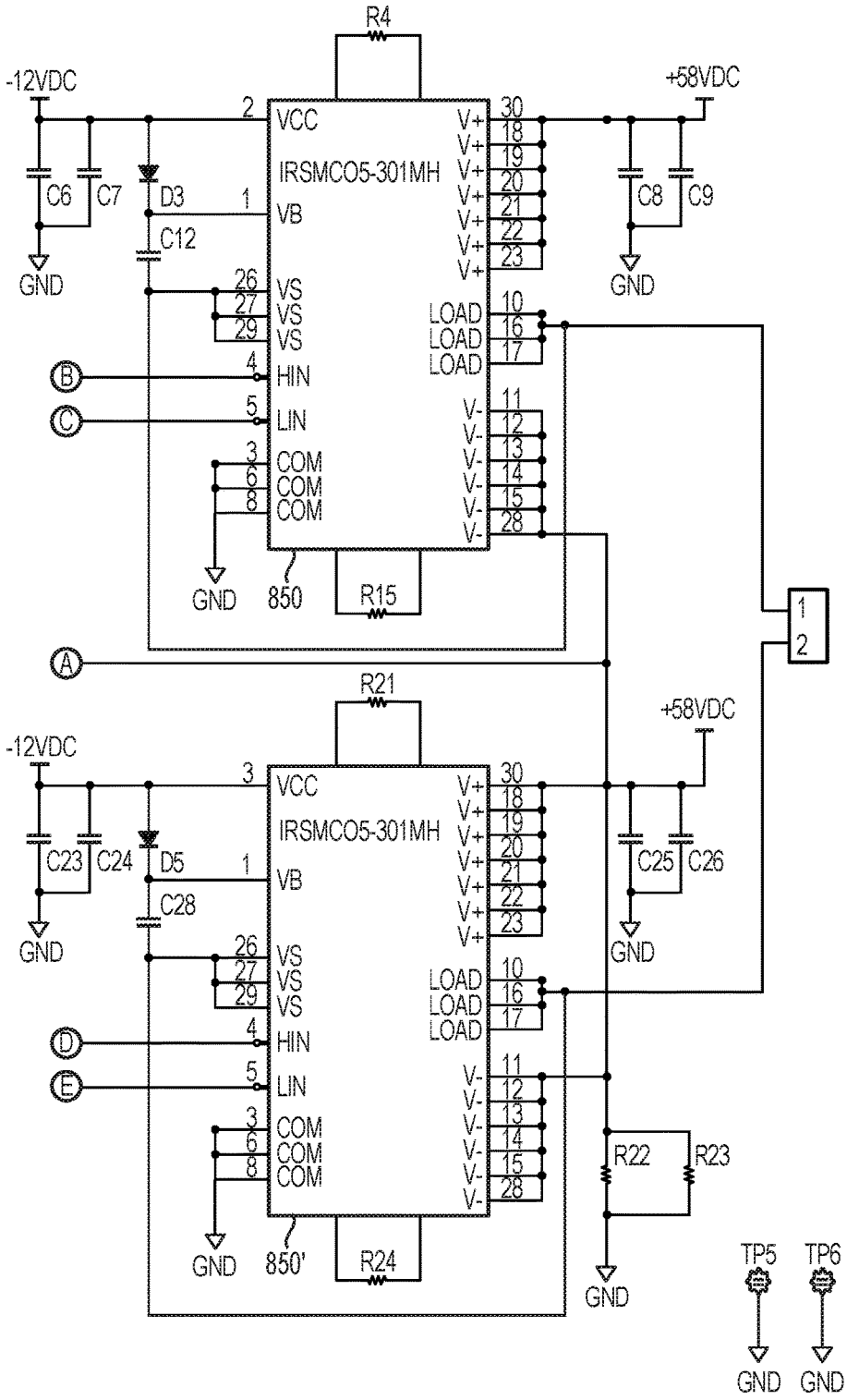
FIG. 8D-II

METHODS FOR ADJUSTING THE LIGHT OUTPUT OF ILLUMINATION SYSTEMS

RELATED APPLICATIONS

This application claims the benefit of and priority to U.S. Provisional Patent Application No. 62/315,112, filed Mar. 30, 2016, the entire disclosure of which is hereby incorporated herein by reference.

FIELD OF THE INVENTION

In various embodiments, the present invention generally relates to illumination, and more specifically to luminaires or lighting systems containing different varieties of light sources.

BACKGROUND

Luminaires and lighting systems for general illumination typically contain one or more light-emitting diodes (LEDs) or other illumination sources that each emit a single color or correlated color temperature (CCT), but lighting systems can include multiple such sources whose outputs combine to provide an overall CCT, color, or illumination spectrum. Controlling the relative outputs of the different sources allows the user to obtain either the individual CCTs or theoretically any mixed combination thereof. This process is herein termed "color mixing" or "color tuning." For convenience, the terms "CCT," "color," and "spectrum" are herein used interchangeably to refer to the spectrum of light emitted by an illumination source. Applications for color mixing are numerous, and include color adjustment to influence mood, perception, learning, and productivity, as well as to convey information.

Conventionally, luminaires featuring LEDs or other illumination sources are commonly dimmed (i.e., brightness-modulated) using any of a variety of techniques, for example increasing or decreasing the power (for example current or voltage) to the LEDs or modulating the power to the LEDs, for example pulse-with modulation (PWM) of the current or voltage.

The overall brightness and overall color of a luminaire that includes multiple LED colors may be modulated by separately modulating the brightness of the LED colors. For example, the output of a luminaire having red, green, and blue LEDs may be made bluer by reducing the power supplying the red and green LEDs relative to the power supplying the blue LED, and may be made dimmer, for any given color mix, by proportionately reducing the power supplying all three LED colors.

However, conventional techniques for adjusting the brightness and color output of a luminaire featuring LED arrays have several limitations and drawbacks. FIG. 1 schematically depicts portions of an illustrative lighting system 100 according to one conventional technique for controlling the brightness and color balance of an LED luminaire. System 100 features a luminaire or lighting system 102 having two different color LEDs 106 and 108. When powered, a first LED (or group of LEDs) 106 radiates light at a first CCT or color, herein termed Color A, and a second LED (or group of LEDs) 108 emits light at a second characteristic CCT or color, herein termed Color B. A first power supply 110 supplies power to Color A LED 106 through wires 114 and 116, and a second power supply 112 supplies power to Color B LED 108 through wires 118 and 120. To adjust the color of the overall output of the luminaire 102, the outputs of the power supplies are raised or lowered relative to each other: for example, if the output of the first power supply 110 is significantly higher than that of the second power supply 112, Color A will dominate the emission spectrum of luminaire 102. Decreasing the outputs of both power supplies 110, 112 while maintaining the outputs' relative magnitudes will cause the luminaire 102 to produce dimmer light of an approximately fixed color. Thus, color mixing and dimming of the luminaire 102 requires adjusting the outputs of the two power supplies 110, 112.

Thus, for a system of M different color LEDs, M separate power supplies need to be provided and separately controlled. Another drawback of conventional techniques is that 2M dedicated wires must typically be run from each power supply to each luminaire or array of luminaires having M distinctive LED colors, in order to provide a separately controllable current loop for each color.

Accordingly, there is a need for techniques by which color mixing and dimming of a luminaire featuring arrays of lighting sources having various CCTs may be achieved using fewer power supplies and fewer wires.

SUMMARY

In accordance with certain embodiments of the present invention, methods and systems are provided for adjusting the overall light output of a luminaire or lighting system having a number of LEDs (or other light-emitting elements) of having different illumination properties. For example, the light-emitting elements (LEEs) may have various colors (i.e., emit differently colored light). In various embodiments, these methods and systems enable the adjustment of the color of the overall light output of such a luminaire or lighting system, the dimming and brightening of such a luminaire or lighting system, and the simultaneous color adjustment and dimming and brightening of such a luminaire or lighting system. Embodiments of the invention reduce the cost and complexity of a dimmable, color-tunable luminaire by using an array of switches to achieve pulse-width modulation of power supplied by a single, constant-output power supply to LEE strings within the luminaire.

In various embodiments, the invention features a single power supply providing two DC voltages, $V_{pos}$ and $V_{neg}$, that are appropriate for powering a number of light-emitting devices (e.g., LEE or LED strings), as well as a number $2N \geq 4$ of switches, where each switch is capable of controllably opening and closing a conductive electrical path. The 2N switches are arranged to control electrical conduction between the $V_{pos}$ and $V_{neg}$ of the power supply and N conductive nodes connected to N wires that supply power to a number of light-emitting devices. In various embodiments, each light-emitting device is capable of being switched On and Off at a rate faster than the flicker fusion threshold of human vision, so that apparently smooth, uninterrupted illumination may be provided as the light-emitting devices are switched On and Off. In various embodiments, the luminaire features light-emitting devices having two or more distinct CCTs or colors. In various embodiments, the 2N switches are opened and closed in a manner that enables the overall light intensity of the luminaire and the overall color of the light output of the luminaire to be adjusted within certain bounds. Specifically, in a first subinterval of time shorter than the flicker fusion threshold, while one or more colors are switched On, one or more other colors are switched Off; in a second subinterval of time, another selection of colors is switched On and another is switched Off; and so forth for some number of subintervals of time.

A periodic series of such patterns of illumination may be produced. Due to the time-averaging properties of human vision, perceived illumination color will depend on the relative amounts of time that some colors are switched On and the amounts of time that other colors are switched On. Moreover, including subintervals of time in which some or all light-producing devices are switched Off will reduce the time-averaged (and thus perceived) brightness of the illumination. Both color mixing and dimming may thus be achieved by appropriate manipulation of the 2N switches.

In various embodiments, each of the 2N switches may be a mechanical device, metal-oxide-semiconductor field-effect transistor (MOSFET), bipolar junction transistor (BJT), insulated-gate bipolar transistor (IGBT), or any other device capable of opening and closing a conductive electrical path. Also, various embodiments feature one or more LEE or LED strings or other light-emitting devices that are not switched On and Off during luminaire operation but are continuously powered, either at a constant voltage or a variable voltage, during luminaire operation.

Herein, reference is frequently made to luminaires featuring LEEs and/or LEDs; however, the systems and methods disclosed herein are applicable to any class of light-emitting devices capable of being switched on and off with sufficient rapidity (e.g., faster than the flicker fusion threshold of human vision), and application of the systems and methods herein disclosed to any and all such devices is intended and within the scope of the invention. Also herein, an "array" of light sources is any independently powered and/or controlled group of 1 or more light sources (e.g., LEEs). Also herein, a luminaire containing two strings of LEEs, where each string has a distinctive overall spectrum, is termed a "two-color luminaire." In general, a luminaire containing strings having L distinctive spectra is herein termed an "L-color luminaire." Each LEE string of an L-string luminaire may include or consist essentially of LEEs of a single color or LEEs of various colors (e.g., a range of colors). Herein, an "LEE" may be a light-emitting diode or any light-emitting device capable of performing the functions described herein, and a "string" of LEEs may refer to (a) a group of one or more LEEs connected in series or (b) two or more such series-connected LEE groups connected in parallel and, in various embodiments, having similar spectral properties. For example, a number of LEE groups wired in parallel and switched On and Off together may be considered a single "string" herein. References herein to LEDs are understood to also include within their scope LEEs of any of various types, i.e., the terms "LED" and "LEE" are generally utilized interchangeably herein unless otherwise indicated.

As utilized herein, the term "light-emitting element" (LEE) refers to any device that emits electromagnetic radiation within a wavelength regime of interest, for example, visible, infrared or ultraviolet regime, when activated, by applying a potential difference across the device or passing a current through the device. Examples of light-emitting elements include solid-state, organic, polymer, phosphor-coated or high-flux LEDs, laser diodes or other similar devices as would be readily understood. The emitted radiation of an LEE may be visible, such as red, blue or green, or invisible, such as infrared or ultraviolet. An LEE may produce radiation of a continuous or discontinuous spread of wavelengths. An LEE may feature a phosphorescent or fluorescent material, also known as a light-conversion material, for converting a portion of its emissions from one set of wavelengths to another. In some embodiments, the light from an LEE includes, consists essentially of, of consists of a combination of light directly emitted by the LEE and light emitted by an adjacent or surrounding light-conversion material. An LEE may include multiple LEEs, each emitting essentially the same or different wavelengths. In some embodiments, a LEE is an LED that may feature a reflector over all or a portion of its surface upon which electrical contacts are positioned. The reflector may also be formed over all or a portion of the contacts themselves. In some embodiments, the contacts are themselves reflective. Herein the term "reflective" is defined as having a reflectivity greater than 65% for a wavelength of light emitted by the LEE on which the contacts are disposed unless otherwise defined. In some embodiments, an LEE may include or consist essentially of an electronic device or circuit or a passive device or circuit. In some embodiments, an LEE includes, consists essentially of, of consists of multiple devices, for example an LED and a Zener diode for static-electricity protection. In some embodiments, an LEE may include, consist essentially of, of consist of a packaged LED, i.e., a bare LED die encased or partially encased in a package. In some embodiments, the packaged LED may also include a light-conversion material. In some embodiments, the light from the LEE may include, consist essentially of, of consist of light emitted only by the light-conversion material, while in other embodiments the light from the LEE may include, consist essentially of, of consist of a combination of light emitted from an LED and from the light-conversion material. In some embodiments, the light from the LEE may include, consist essentially of, of consist of light emitted only by an LED. In various embodiments, an LEE includes, consists essentially of, of consists of a bare semiconductor die, while in other embodiments an LEE includes, consists essentially of, of consists of a packaged LED.

In an aspect, embodiments of the invention feature an illumination system including, consisting essentially of, or consisting of a power supply, a first string of two or more light-emitting elements, a second string of two or more light-emitting elements, and a switch array. The first string is configured to emit light of a first optical characteristic. The second string is configured to emit light of a second optical characteristic. The second optical characteristic may be different from the first optical characteristic. The switch array is configured to selectively electrically couple the power supply to the first and second strings, thereby enabling (i) selection of an overall optical characteristic of light emitted by the illumination system, independent of an overall intensity of the light emitted by the illumination system, by (a) forward biasing the first string and reverse biasing the second string or (b) reverse biasing the first string and forward biasing the second string, and (ii) dimming of light emitted by the illumination system, independent of the overall optical characteristic of the light emitted by the illumination system, by selectively disconnecting the first and second strings from the power supply.

Embodiments of the invention may include one or more of the following in any of a variety of combinations. The switch array may include, consist essentially of, or consist of a plurality of nodes. The switch array may include, consist essentially of, or consist of a first node electrically coupled to an anode end of the first string and a cathode end of the second string, and a second node electrically coupled to a cathode end of the first string and an anode end of the second string. The illumination system may include a third string of one or more light-emitting elements. The third string may be electrically coupled to the power supply via an electrical connection not regulated by the switch array. The first optical characteristic may include, consist essentially of, or consist of color, color point, correlated color temperature, color rendering index, R9, spectral power distribution, intensity, and/or spatial intensity distribution. The second optical characteristic may include, consist essentially of, or consist of color, color point, correlated color temperature, color rendering index, R9, spectral power distribution, intensity, and/or spatial intensity distribution. The overall optical characteristic may include, consist essentially of, or consist of color, color point, correlated color temperature, color rendering index, R9, spectral power distribution, intensity, and/or spatial intensity distribution. The overall optical characteristic may include, consist essentially of, or consist of color, color point, correlated color temperature, color rendering index, R9, spectral power distribution, and/or spatial intensity distribution. The first string and/or the second string may include, consist essentially of, or consist of at least five light-emitting elements, at least ten light-emitting elements, or at least 50 light-emitting elements. At least some of the light-emitting elements of the first string and/or the second string may be electrically coupled in series. The switch array may include, consist essentially of, or consist of an H-bridge circuit. The switch array may include, consist essentially of, or consist of at least two half-bridge circuits. The illumination system may include a control system for controlling a relative amount of time the first string and the second string are electrically coupled to the power supply. The control system may be configured to accept as an input at least two control signals. One control signal may correspond to the overall intensity of the light emitted by the illumination system, and another control signal may correspond to the overall optical characteristic. The power supply may supply power to the first and second strings independent of the at least two control signals.

The first string may include, consist essentially of, or consist of at least five first groups of light-emitting elements. Each first group may include, consist essentially of, or consist of two or more light-emitting elements. The second string may include, consist essentially of, or consist of at least five second groups of light-emitting elements. Each second group may include, consist essentially of, or consist of two or more light-emitting elements. At least some of the first groups may be coupled together in series. At least some of the first groups may be coupled together in parallel. The light-emitting elements in at least one of the first groups may be coupled in series. The light-emitting elements in at least one of the first groups may be coupled in parallel. At least some of the second groups may be coupled together in series. At least some of the second groups may be coupled together in parallel. The light-emitting elements in at least one of the second groups may be coupled in series. The light-emitting elements in at least one of the second groups may be coupled in parallel. The number of first groups may be equal to the number of second groups. The switch array may be configured to selectively electrically couple the power supply to the first and second strings at a frequency greater than approximately 500 Hz. The switch array may be configured to selectively electrically couple the power supply to the first and second strings at a frequency between approximately 500 Hz and approximately 10 kHz. The switch array may include, consist essentially of, or consist of two or more mechanical switches, two or more relays, and/or two or more transistors.

In another aspect, embodiments of the invention feature an illumination system including, consisting essentially of, or consisting of a power supply, a first string of two or more light-emitting elements, a second string of two or more light-emitting elements, and a switch array. The first string is configured to emit light of a first range of optical characteristics. The first string includes, consists essentially of, or consists of a first group of one or more light-emitting elements and a second group of one or more light-emitting elements. The first and second groups are anti-parallel connected (i.e., connected in parallel but with opposite polarities). The second string is configured to emit light of a second range of optical characteristics. The second string includes, consists essentially of, or consists of a third group of one or more light-emitting elements and a fourth group of one or more light-emitting elements. The third and fourth groups are anti-parallel connected (i.e., connected in parallel but with opposite polarities). The switch array is configured to selectively electrically couple the power supply to the first and second strings, thereby enabling (i) selection of an overall optical characteristic of light emitted by the illumination system, independent of an overall intensity of the light emitted by the illumination system, by (a) forward biasing only one of the first or second groups and/or (b) forward biasing only one of the third or fourth groups, and (ii) dimming of light emitted by the illumination system, independent of the overall optical characteristic of the light emitted by the illumination system, by selectively disconnecting the first and second strings from the power supply.

Embodiments of the invention may include one or more of the following in any of a variety of combinations. The second range of optical characteristics may be different from the first range of optical characteristics. At least a portion of the first range of optical characteristics may overlap with at least a portion of the second range of optical characteristics. The first range of optical characteristics may not overlap with the second range of optical characteristics. The first range of optical characteristics may range from an optical characteristic produced by the first group to an optical characteristic produced by the second group. The second range of optical characteristics may range from an optical characteristic produced by the third group to an optical characteristic produced by the fourth group. The illumination system may include a third string of one or more light-emitting elements. The third string may be electrically coupled to the power supply via an electrical connection not regulated by the switch array. The first range of optical characteristics may include, consist essentially of, or consist of a range of colors, color points, correlated color temperatures, color rendering indices, R9s, spectral power distributions, intensities, and/or spatial intensity distributions. The second range of optical characteristics may include, consist essentially of, or consist of a range of colors, color points, correlated color temperatures, color rendering indices, R9s, spectral power distributions, intensities, and/or spatial intensity distributions. The overall optical characteristic may include, consist essentially of, or consist of color, color point, correlated color temperature, color rendering index, R9, spectral power distribution, intensity, and/or spatial intensity distribution. The overall optical characteristic may include, consist essentially of, or consist of color, color point, correlated color temperature, color rendering index, R9, spectral power distribution, and/or spatial intensity distribution. The switch array may include, consist essentially of, or consist of an H-bridge circuit. The switch array may include, consist essentially of, or consist of at least two half-bridge circuits. The illumination system may include a control system for controlling a relative amount of time the first string and the second string are electrically coupled to the power supply. The control system may be configured to accept as an input at least two control signals. One control signal may correspond to the overall intensity of the light emitted by the illumination system, and another control signal may correspond to the overall optical characteristic. The power supply may supply power to the first and second strings independent of the at least two control signals. The switch array may be configured to selectively electrically couple the power supply to the first and second strings at a frequency greater than approximately 500 Hz. The switch array may be configured to selectively electrically couple the power supply to the first and second strings at a frequency between approximately 500 Hz and approximately 10 kHz. The switch array may include, consist essentially of, or consist of two or more mechanical switches, two or more relays, and/or two or more transistors.

In yet another aspect, embodiments of the invention feature an illumination system including, consisting essentially of, or consisting of a power supply, a first string of two or more light-emitting elements, a second string of two or more light-emitting elements, a third string of two or more light-emitting elements, and a switch array. The first string is configured to emit light of a first optical characteristic. The second string is configured to emit light of a second optical characteristic. The second optical characteristic may be different from the first optical characteristic. The third string is configured to emit light of a third optical characteristic. The third optical characteristic may be different from the first optical characteristic and/or the second optical characteristic. The switch array is configured to selectively electrically couple the power supply to the first, second, and third strings, thereby enabling (i) selection of an overall optical characteristic of light emitted by the illumination system, independent of an overall intensity of the light emitted by the illumination system, by (a) forward biasing at least one of the first, second, or third strings and (b) reverse biasing any of the first, second, or third strings that are not forward biased, and (ii) dimming of light emitted by the illumination system, independent of the overall optical characteristic of the light emitted by the illumination system, by selectively disconnecting the first, second, and third strings from the power supply.

Embodiments of the invention may include one or more of the following in any of a variety of combinations. The third optical characteristic may be the same as the first optical characteristic. The third optical characteristic may be the same as the second optical characteristic. The illumination system may include a fourth string of one or more light-emitting elements. The fourth string may be electrically coupled to the power supply via an electrical connection not regulated by the switch array. The first optical characteristic may include, consist essentially of, or consist of color, color point, correlated color temperature, color rendering index, R9, spectral power distribution, intensity, and/or spatial intensity distribution. The second optical characteristic may include, consist essentially of, or consist of color, color point, correlated color temperature, color rendering index, R9, spectral power distribution, intensity, and/or spatial intensity distribution. The third optical characteristic may include, consist essentially of, or consist of color, color point, correlated color temperature, color rendering index, R9, spectral power distribution, intensity, and/or spatial intensity distribution. The overall optical characteristic may include, consist essentially of, or consist of color, color point, correlated color temperature, color rendering index, R9, spectral power distribution, intensity, and/or spatial intensity distribution. The overall optical characteristic may include, consist essentially of, or consist of color, color point, correlated color temperature, color rendering index, R9, spectral power distribution, and/or spatial intensity distribution. The first string, the second string, and/or the third string may include, consist essentially of, or consist of at least five light-emitting elements, at least ten light-emitting elements, or at least 50 light-emitting elements. At least some of the light-emitting elements of the first string, the second string, and/or the third string may be electrically coupled in series. The switch array may include, consist essentially of, or consist of an H-bridge circuit. The switch array may include, consist essentially of, or consist of at least two half-bridge circuits. The illumination system may include a control system for controlling a relative amount of time the first string, the second string, and the third string are electrically coupled to the power supply. The control system may be configured to accept as an input at least two control signals. One control signal may correspond to the overall intensity of the light emitted by the illumination system, and another control signal may correspond to the overall optical characteristic. The power supply may supply power to the first string, the second string, and the third string independent of the at least two control signals. The switch array may be configured to selectively electrically couple the power supply to the first string, the second string, and the third string at a frequency greater than approximately 500 Hz. The switch array may be configured to selectively electrically couple the power supply to the first string, the second string, and the third string at a frequency between approximately 500 Hz and approximately 10 kHz. The switch array may include, consist essentially of, or consist of two or more mechanical switches, two or more relays, or two or more transistors. The switch array may include, consist essentially of, or consist of three or more mechanical switches, three or more relays, or three or more transistors. The switch array may include, consist essentially of, or consist of six or more mechanical switches, six or more relays, or six or more transistors.

In another aspect, embodiments of the invention feature an illumination system including, consisting essentially of, or consisting of a power supply, a first plurality of strings, a second plurality of strings, and a switch array. The first plurality of strings is configured to collectively emit light of a first optical characteristic. Each of the first plurality of strings includes, consists essentially of, or consists of two or more light-emitting elements. The first plurality of strings is electrically coupled together in parallel. Each of the first plurality of strings has a first polarity (i.e., the anodes and cathodes of the light-emitting elements in each of the first plurality of strings have the same orientation). The second plurality of strings is configured to collectively emit light of a second optical characteristic. The second optical characteristic may be different from the first optical characteristic. Each of the second plurality of strings includes, consists essentially of, or consists of two or more light-emitting elements. The second plurality of strings is electrically coupled together in parallel. Each of the second plurality of strings has a second polarity (i.e., the anodes and cathodes of the light-emitting elements in each of the second plurality of strings have the same orientation). The second polarity is different from (e.g., opposite to) the first polarity. The switch array is configured to selectively electrically couple the power supply to the first and second pluralities of strings, thereby enabling (i) selection of an overall optical characteristic of light emitted by the illumination system, independent of an overall intensity of the light emitted by the illumination system, by (a) forward biasing the first plurality of strings and reverse biasing the second plurality of strings or (b) reverse biasing the first plurality of strings and forward biasing the second plurality of strings, and (ii) dimming of light emitted by the illumination system, independent of the overall optical characteristic of the light emitted by the illumination system, by selectively disconnecting the first and second pluralities of strings from the power supply.

Embodiments of the invention may include one or more of the following in any of a variety of combinations. The switch array may include, consist essentially of, or consist of a plurality of nodes. The switch array may include, consist essentially of, or consist of a first node electrically coupled to an anode end of each of the first plurality of strings and a cathode end of each of the second plurality of strings, and a second node electrically coupled to a cathode end of each of the first plurality of strings and an anode end of each of the second plurality of strings. The illumination system may include a third string of one or more light-emitting elements. The third string may be electrically coupled to the power supply via an electrical connection not regulated by the switch array. The first optical characteristic may include, consist essentially of, or consist of color, color point, correlated color temperature, color rendering index, R9, spectral power distribution, intensity, and/or spatial intensity distribution. The second optical characteristic may include, consist essentially of, or consist of color, color point, correlated color temperature, color rendering index, R9, spectral power distribution, intensity, and/or spatial intensity distribution. The overall optical characteristic may include, consist essentially of, or consist of color, color point, correlated color temperature, color rendering index, R9, spectral power distribution, intensity, and/or spatial intensity distribution. The overall optical characteristic may include, consist essentially of, or consist of color, color point, correlated color temperature, color rendering index, R9, spectral power distribution, and/or spatial intensity distribution.

At least one string (or even all strings) of the first plurality of strings may include, consist essentially of, or consist of at least five light-emitting elements, at least ten light-emitting elements, or at least 50 light-emitting elements. At least one string (or even all strings) of the second plurality of strings may include, consist essentially of, or consist of at least five light-emitting elements, at least ten light-emitting elements, or at least 50 light-emitting elements. At least some of the light-emitting elements of at least one string (or even all strings) of the first plurality of strings may be electrically coupled in series. At least some of the light-emitting elements of at least one string (or even all strings) of the second plurality of strings may be electrically coupled in series. The switch array may include, consist essentially of, or consist of an H-bridge circuit. The switch array may include, consist essentially of, or consist of at least two half-bridge circuits. The illumination system may include a control system for controlling a relative amount of time the first plurality of strings and the second plurality of strings are electrically coupled to the power supply. The control system may be configured to accept as an input at least two control signals. One control signal may correspond to the overall intensity of the light emitted by the illumination system, and another control signal may correspond to the overall optical characteristic. The power supply may supply power to the first plurality of strings and the second plurality of strings independent of the at least two control signals. The switch array may be configured to selectively electrically couple the power supply to the first plurality of strings and the second plurality of strings at a frequency greater than approximately 500 Hz. The switch array may be configured to selectively electrically couple the power supply to the first plurality of strings and the second plurality of strings at a frequency between approximately 500 Hz and approximately 10 kHz. The switch array may include, consist essentially of, or consist of two or more mechanical switches, two or more relays, and/or two or more transistors.

In another aspect, embodiments of the invention feature a method of operating, over a plurality of time intervals, an illumination system including, consisting essentially of, or consisting of (i) only a single power supply and (ii) a plurality of strings of light-emitting elements. Two or more of the strings are configured to emit light of different optical characteristics. An overall optical characteristic of light to be emitted by the illumination system over the plurality of time intervals is selected by, during each time interval, forward biasing one or more strings while reverse biasing one or more other strings. Different strings may be forward biased and/or reversed biased during each time interval. An overall intensity of light to be emitted by the illumination system over the plurality of time intervals is selected by, during each time interval, connecting one or more strings to the power supply and/or disconnecting one or more strings from the power supply. Different strings may be connected to and/or disconnected from the power supply during each time interval. The selection of the overall optical characteristic may be independent of the selected overall intensity. The selection of the overall intensity may be independent of the selected overall optical characteristic.

Embodiments of the invention may include one or more of the following in any of a variety of combinations. The time intervals may proceed at a frequency between approximately 500 Hz and approximately 10 kHz (i.e., the frequency of changing which strings are forward or reversed biased, and/or connected to or disconnected from the power supply, may be between approximately 500 Hz and approximately 10 kHz). The time intervals may proceed at a frequency greater than approximately 500 Hz. Power may be supplied to at least one of the strings at a substantially constant level over all of the time intervals, without disconnection from the power supply, irrespective of the selected overall optical characteristic and the selected overall intensity. The overall optical characteristic and/or the overall intensity may be selected via operation of two or more switches within a switch array. The switch array may include, consist essentially of, or consist of 2N switches. The plurality of strings may include, consist essentially of, or consist of C/2 strings, C being equal to $N!/[(N-2)!2]$. The strings may be connected to the power supply by a plurality of wires (i.e., electrical conductors). The number of the wires may be approximately one-half of a number of switches within the switch array. At least one (or even all) of the switches may include, consist essentially of, or consist of a mechanical switch, a relay, and/or a transistor. The switch array may include, consist essentially of, or consist of an H-bridge circuit. The switch array may include, consist essentially of, or consist of at least two half-bridge circuits. The overall optical characteristic may include, consist essentially of, or consist of color, color point, correlated color temperature, color rendering index, R9, spectral power distribution, and/or spatial intensity distribution. The plurality of strings may include, consist essentially of, or consist of two or more strings, three or more strings, four or more strings, five or more strings, six or more strings, ten or more strings, or twenty or more strings. At least one (or even all) of the strings may include, consist essentially of, or consist of at least five light-emitting elements, at least ten light-emitting elements, or at least 50 light-emitting elements. The plurality of strings may include, consist essentially of, or consist of a first plurality of strings and a second plurality of strings. The first plurality of strings may each include, consist essentially of, or consist of two or more light-emitting elements. The first plurality of strings may be electrically coupled together in parallel. The first plurality of strings may each have a first polarity. The second plurality of strings may each include, consist essentially of, or consist of two or more light-emitting elements. The second plurality of strings may be electrically coupled together in parallel. The second plurality of strings may each have a second polarity different from (e.g., opposite to) the first polarity.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. Reference throughout this specification to "one example," "an example," "one embodiment," or "an embodiment" means that a particular feature, structure, or characteristic described in connection with the example is included in at least one example of the present technology. Thus, the occurrences of the phrases "in one example," "in an example," "one embodiment," or "an embodiment" in various places throughout this specification are not necessarily all referring to the same example. Furthermore, the particular features, structures, routines, steps, or characteristics may be combined in any suitable manner in one or more examples of the technology. As used herein, the terms "about," "approximately," and "substantially" mean±10%, and in some embodiments, ±5%. The term "consists essentially of" means excluding other materials that contribute to function, unless otherwise defined herein. Nonetheless, such other materials may be present, collectively or individually, in trace amounts.

Herein, two components such as light-emitting elements and/or optical elements being "aligned" or "associated" with each other may refer to such components being mechanically and/or optically aligned. By "mechanically aligned" is meant coaxial or situated along a parallel axis. By "optically aligned" is meant that at least some light (or other electromagnetic signal) emitted by or passing through one component passes through and/or is emitted by the other. As used herein, the terms "phosphor," "wavelength-conversion material," and "light-conversion material" refer to any material that shifts the wavelength of light striking it and/or that is luminescent, fluorescent, and/or phosphorescent.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which:

FIG. 8D, split into FIG. 8D-I and FIG. 8D-II on separate pages for clarity, depicts a circuit for a lighting system in accordance with various embodiments of the invention.

DETAILED DESCRIPTION

Herein, systems and methods are disclosed that reduce the complexity (e.g., power supply count, wire count) and expense of controlling the color balance and brightness of luminaires featuring LEE strings of two or more colors. In various embodiments, such systems and methods may also be used to control other characteristics of LEEs and lighting systems, as will be described herein.

Figure 2A:
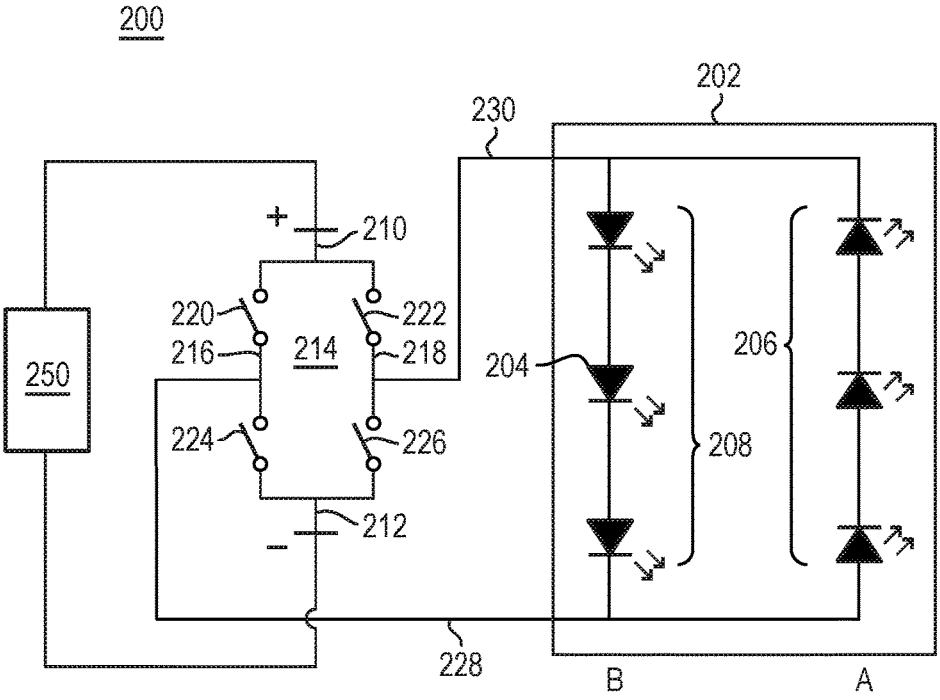
FIG. 2A depicts color mixing in a luminaire featuring two colors in accordance with various embodiments of the invention.

FIG. 2A schematically depicts portions of an illustrative lighting system 200 in which the brightness and color balance of a luminaire are controlled according with various embodiments of the present invention. System 200 features a luminaire 202 having two strings of LEEs (e.g., LEE 204). When powered, a first string 206 emits light at a characteristic Color A, and a second string 208 emits light at a characteristic Color B, different from Color A. For example, in various embodiments of the present invention Colors A and B may be white, with two different color points or correlated color temperatures (CCTs), e.g., Color A may have a CCT in the range of about 1000K to about 3000K, while Color B may have a CCT in the range of about 3500K to about 15000K. However, this is not a limitation of the present invention, and in other embodiments Color A and Color B may have different color points or CCTs, or may have colors different from white, for example red, green, blue, or the like. In the illustrative system 200, it is presumed the strings 206, 208 have approximately equivalent forward voltages; however, this is not a limitation of the present invention, as will be discussed herein. A power supply 250 supplies power to terminals 210 and 212 of a switch array 214 that features two nodes 216, 218 and four switches 220, 222, 224, 226. Luminaire 202 is electrically coupled to nodes 216 and 218, for example through wires 228 and 230. Wire 228 (and/or conductors connected thereto and internal to the luminaire 202) connects to the anode end of string 206 and the cathode end of string 208; wire 230 (and/or conductors connected thereto and internal to the luminaire 202) connects to the cathode end of string 206 and the anode end of string 208. Thus, a voltage difference between the two wires 228, 230 may forward-bias (turn on) either string 206 or 208 but typically cannot forward-bias both strings 206, 208 simultaneously.

The switches 220, 222, 224, 226 may be variously set open and closed to achieve three operational states of system 200:

1) Off state: all switches open, neither string 206 nor string 208 On. The Off state is depicted in FIG. 2A.

Figure 2B:
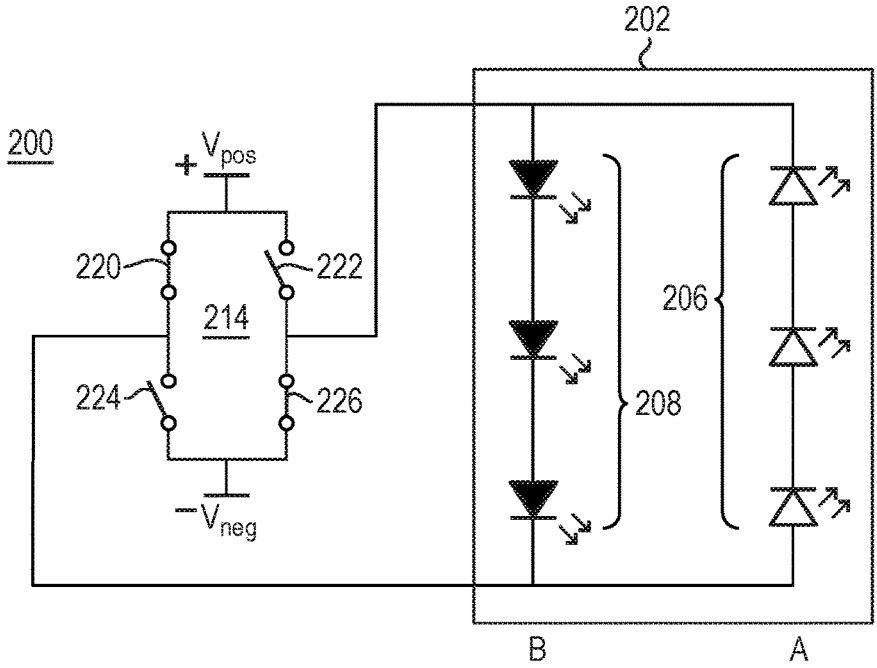
FIG. 2B depicts the system of FIG. 2A in a second state of operation.

2) Color A state, depicted in FIG. 2B: switches 220, 226 closed, switches 222, 224 open; Color A string 206 On, Color B string 208 Off.

Figure 2C:
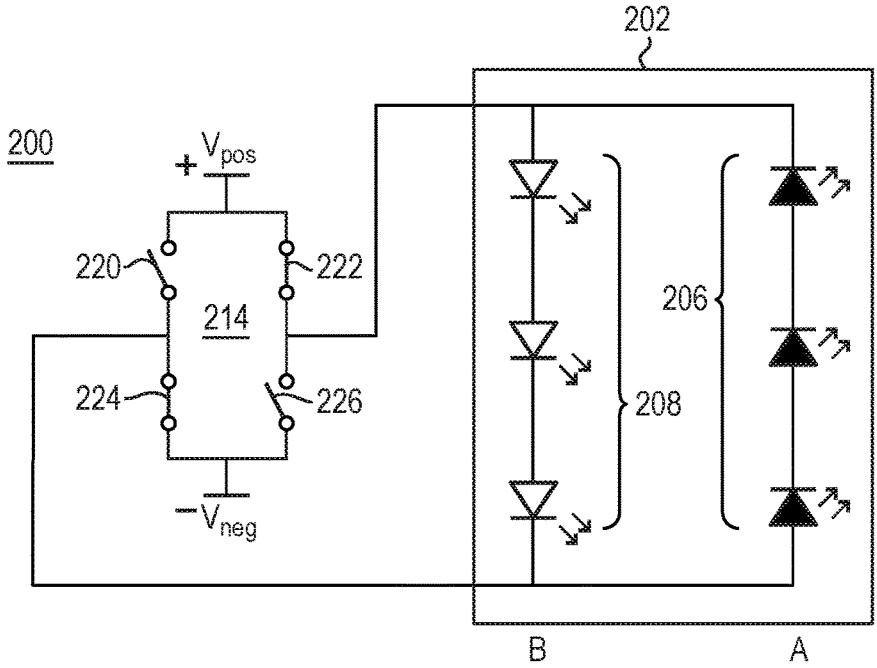
FIG. 2C depicts the system of FIG. 2A in a third state of operation.

3) Color B state, depicted in FIG. 2C: switches 220, 226 open, switches 222, 224 closed; Color A LEE string 206 Off, Color B LEE string 208 On.

Operational states in which switches 220, 224 and/or switches 222, 226 are simultaneously closed may short the power supply 250 and in various embodiments are forbidden states; in various embodiments, mechanical, electronic, software or other (or combinations of) interlocks (not depicted) within the switch array 214 may prevent the occurrence of these states. In various embodiments of the present invention, power supply 250 itself may provide fault protection (e.g., power supply 250 may be an off-the-shelf supply) and shut itself off in the event of a fault condition, for example a short circuit of the load. In various embodiments of the present invention, switches 220, 224 and/or switches 222, 226 may be implemented in a timed sequence, for example to ensure no overlap of On times or to include a period between each switching sequence when all switches are open, i.e., a "deadtime," for example of about 10 ns to about 1000 ns. However, the magnitude of the deadtime is not a limitation of the present invention. In various embodiments, switch array 214 may be implemented with a "break-before-make" function, i.e., the switch to be opened is opened before the switch to be closed is closed, even at times when the various switches are nominally to be operated (i.e., opened or closed) approximately simultaneously.

Although it is generally not possible in system 200 to turn both LEE strings 206, 208 On at the same time, they may be made apparently On at the same time by switching with sufficient rapidity (i.e., at a rate exceeding the flicker fusion threshold of human vision, for example any frequency greater than about 100 Hz, such as greater than or equal to about 1 kHz or greater than or equal to about 2 kHz or greater than or equal to about 3 kHz or greater than or equal to about 10 kHz) between the Color A state and the Color B state. Further, if in each of a series of time intervals of similar or identical length (herein termed "switching intervals") one string is kept On longer than the other, the perceived color of the illumination from luminaire 202 will be weighted toward the color of the string that is kept on longer. At one extreme, string 206 (Color A) is On 100% of each interval; at another extreme, string 208 (Color B) is on 100% of each interval. Between these extremes, as shall be further clarified in FIGS. 3A, 3B, 4A, and 4D, Color A may be On for x percent of each interval and Color B may be On for (100−x) percent of each interval, where each x corresponds to a distinct color mix. More generally, each interval may also include a subinterval during which the luminaire 202 is Off; that is, Color A may be On x percent of each interval, Color B may be On y percent of each interval, and both colors may be Off for (100−x−y) percent of each interval. Here, $x+y \leq 100$. When $x+y=100$ there is no Off subinterval. Here, each x/y value corresponds to a distinct color mix and each x+y value corresponds to a distinct brightness. The allocation of any portion of each switching interval to the Off state will have the perceptual effect of dimming in the luminaire 202.

In a mode of operation of system 200 that provides a fixed color mix of a fixed brightness, the switching pattern of each time interval is repeated (i.e., switching is cyclic or periodic); however, acyclic or aperiodic switching may also be implemented. For example, to change from one color mix to another, and/or from one brightness level to another, x and y may change from initial values $x_I$ and $y_I$ to end values $x_E$ and $y_E$. This change may occur either suddenly, from one interval to the next, or gradually over N intervals during which x sequentially takes on N values $x_I<x_i<x_E$ and y takes on N values $y_I<y_i<y_E$ (i=1, 2 . . . N). Color mix and brightness may be varied in this manner independently and/or simultaneously, since x/y (color mix) may be varied while holding x+y (brightness) constant, or vice versa, or both may be varied at once. The technique of operation just described is illustrative only and does not preclude other techniques of operation: for example, y may vary over a different number of steps than x during a transition. More generally, completely aperiodic operation (employing no fixed interval) is also possible.

Figure 1:
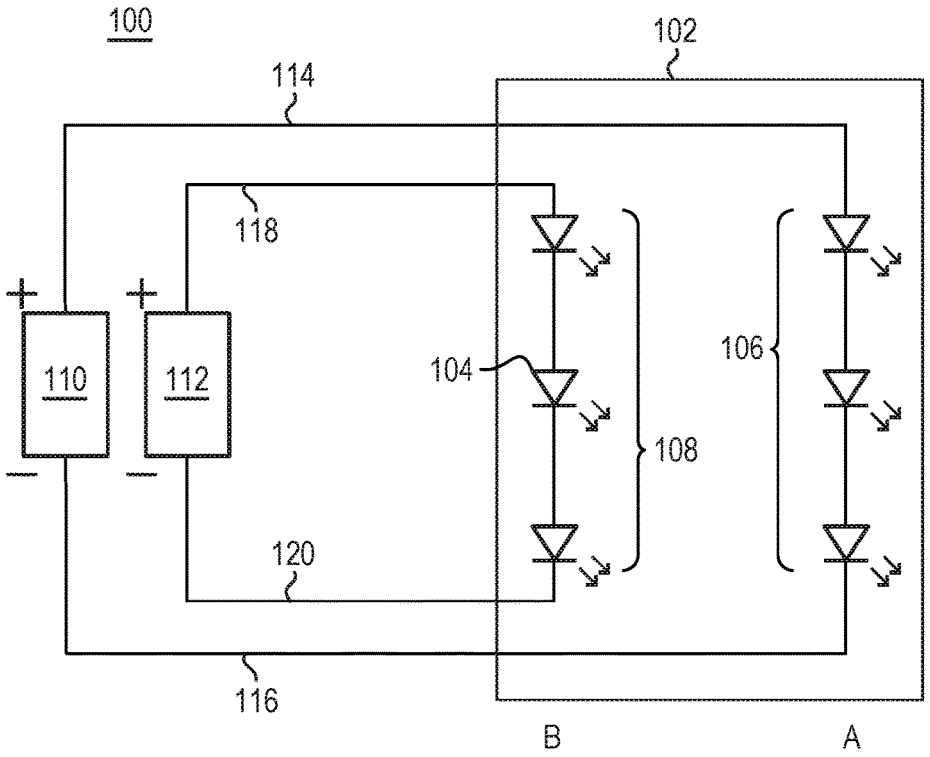
FIG. 1 PRIOR ART
FIG. 1 schematically depicts a conventional color mixing technique using LEDs.

An advantage of the system of FIG. 2A over the conventional system of FIG. 1 is that four wires 114, 116, 118, 120 are required to power the luminaire 102 of system 100 in FIG. 1, but only two wires 228, 230 are used to power the luminaire 202 of FIG. 2A. Also, two variable power supplies must be supplied for color mixing and dimming of the luminaire 102 of system 100, but only one power supply need be supplied for color mixing and dimming of the luminaire 202 of FIG. 2A. Although a switch network 214 is utilized for system 200 of FIG. 2A, the power supply 250 of system 200 may be provided by a fixed-output supply, which is inherently simpler than the variable-output supply required for the conventional system of FIG. 1. There is thus a net gain in simplicity and material savings for the system 200 of FIG. 2A compared with the system 100 of FIG. 1—fewer power supplies and fewer electrical connections and wires advantageously traded off for a relatively simple switch network. The reduced number of components may also result in increased reliability, e.g., through the reduction of connection points. In various embodiments, a portion of the cost savings may be invested in increasing the reliability of the single power supply, further increasing reliability. As will be discussed herein, embodiments of the present invention may be scaled to more than two different color emitters, resulting in increasingly significant savings through the reduction of the number of power supplies and electrical connections required.

In various embodiments of the present invention, only one LEE string 206 or 208 of system 200 may be On at a given time. Thus, in various embodiments, the maximum brightness of the luminaire 202 may be about one half that of the capability of the LEEs in luminaire 202 (e.g., if LEE strings 206 and 208 were both on 100% of the time). In various embodiments of the present invention, the brightness may be increased by pulsed over-driving of the LEE strings 206, 208. For example, in various embodiments LEE 204 may include, consist essentially of, or consist of an LED. As known to those of skill in the art, a typical LED may be driven for relatively brief periods of time at a higher current than its maximum rating for continuous operation, as long as the LED temperature does not exceed acceptable device-temperature operating limits. Thus, in various embodiments of the present invention, LED strings 206, 208 may be driven at a higher current in pulsed mode than the LED strings 106, 108 of FIG. 1 (or the LED strings 206, 208 themselves) may be driven continuously. In typical operating regimes, higher drive current will produce higher light output, and thus operating at higher pulsed currents may be used to compensate on average for Off subintervals and thus result in higher light intensity. In a simplified example, if the relationship between operating current and brightness or intensity is linear or substantially linear, driving all of the LEDs at a current I will result in substantially the same brightness as driving the LEDs at a current 2I for half of the time (e.g., each group of LEDs A and B on 50% of the time). Chromaticity shift and device lifetime reduction may be limiting factors for substantial pulsed over-current driving of LEDs, but for pulsed overdriving within the maximum operational limits (based on, for example, LED temperature) such effects may be substantially insignificant or manageable in various embodiments, allowing luminaire brightness loss to be mitigated or substantially eliminated without unacceptable impacts on color and device longevity.

Figure 2D:
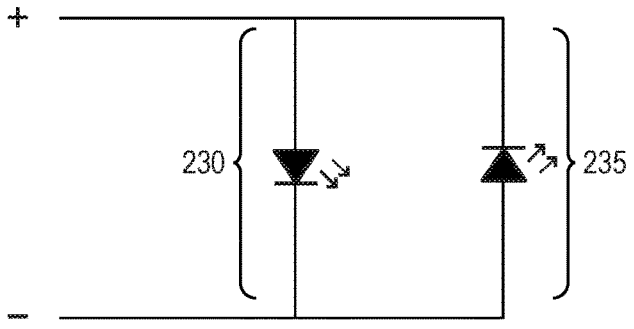
FIGS. 2D-2F depict various configurations of LEEs in accordance with various embodiments of the invention.
Figure 2E:
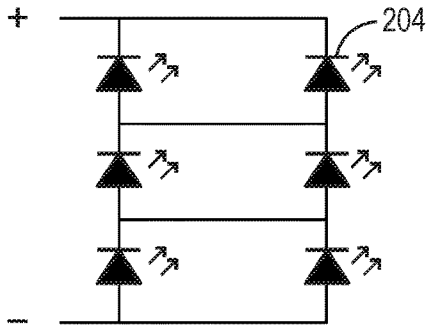
Figure 2F:
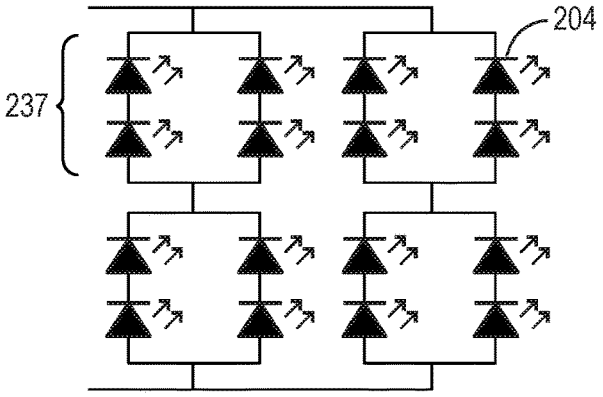

In FIG. 2A, the luminaire 202 is depicted as having two LEE strings 206, 208, and each string 206 or 208 is depicted as including 3 LEEs electrically coupled in series. These arrangements are illustrative only: in general, any number of strings per luminaire or of LEEs per string or arrangement of LEEs within a string may be utilized by various other embodiments, and all such variations are contemplated and within the scope of the invention. In various embodiments of the present invention, a lighting system may include two branches, with one branch 230 in a forward-bias configuration and a second branch 235 in a reverse-bias configuration, as shown in FIG. 2D. While FIG. 2D shows one branch of the reverse-bias configuration and one branch of the forward-bias configuration, this is not a limitation of the present invention, and other embodiments may include more than one forward-bias branch and/or more than one reverse-bias branch. In FIG. 2A, LEEs are arranged in series-connected strings; however, this is not a limitation of the present invention, and in other embodiments other arrangements of LEEs may be utilized in each branch, for example parallel connections, series/parallel connections or any arbitrary arrangements of LEEs. For example, FIG. 2E shows an example of a branch configuration including an array of LEEs in a cross-connected electrical topology while FIG. 2F shows an example of a branch configuration including two parallel-connected strings of two groups 237 in series, each group including two strings of two LEEs in series.

In various embodiments of the present invention, switch array 214 may drive or energize an arbitrarily large number of LEEs, in many different electrical configurations. For example, in various embodiments each string of LEEs may include, consist essentially of, or consist of at least 5 LEEs, at least 10 LEEs, at least 18 LEEs, or more LEEs. In various embodiments of the present invention, switch array 214 advantageously decouples the control functionality from the power functionality, permitting a wide range of LEE configurations, particularly for large arrays of LEEs. In various embodiments, the size of the LEE array may be limited by, for example, the power supply capability and/or the voltage and/or current limits of the switches in switch array 214, but not by the configuration of the LEE array.

While FIG. 2A shows switch array 214 as separate from luminaire 202, this is not a limitation of the present invention, and in other embodiments luminaire 202 may include all or part of switch array 214 or may include other components (for example power supply 250).

In various embodiments, power supply 250 may include, consist essentially of, or consist of a constant or substantially constant voltage power supply, while in other embodiments it may include, consist essentially of, or consist of a constant or substantially constant current supply; however, this is not a limitation of the present invention, and in other embodiments power supply 250 may provide other forms of power, for example modulated power, as described herein. In various embodiments of the present invention, power supply 250 may provide a voltage having a value in the range of about 10 volts to about 100 volts, or in the range of about 20 volts to about 60 volts; however, this is not a limitation of the present invention, and in other embodiments the voltage may be higher or lower. In various embodiments of the present invention, the power from power supply 250 may be modulated, for example pulse-width modulated.

Figure 2G:
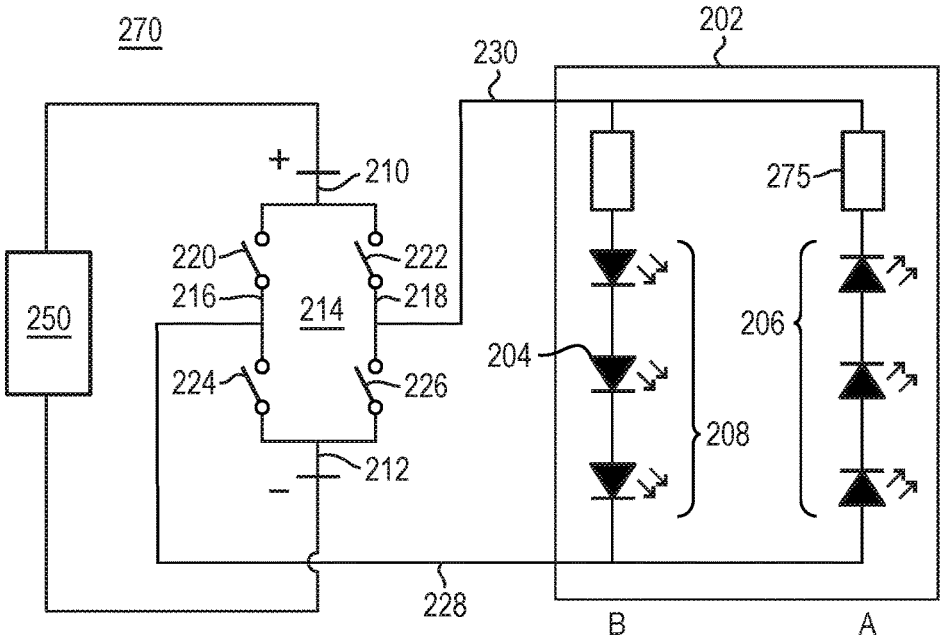
FIG. 2G depicts a schematic of a lighting system in accordance with various embodiments of the invention.

FIG. 2G shows a schematic of an exemplary lighting system 270 in accordance with various embodiments of the present invention. System 270 of FIG. 2G is similar to system 200 of FIG. 2A; however, system 270 includes current control element (CCE) 275 in series with LEEs 204. In various embodiments, power supply 250 includes, consists essentially of, or consists of a constant or substantially constant voltage power supply, and CCE 275 acts to regulate or control the current in each series-connected string to a constant or substantially constant value, for example as described in U.S. patent application Ser. No. 13/799,807, filed on Mar. 13, 2013, and U.S. patent application Ser. No. 13/970,027, filed on Aug. 19, 2013, the entire disclosure of each of which is incorporated herein by reference.

In various embodiments, CCE 275 may act to take up excess voltage within each string that is not dropped across the LEEs, for example across LEE string 206. In various embodiments, LEEs 204 may have different forward voltages, for example because of manufacturing variations or because LEEs may be utilized that have different bandgaps, for example to emit at different colors. For example, LEEs within string 206 may have a first bandgap while LEEs within string 208 may have a second bandgap different from the first bandgap, and the voltage across an CCE 275 electrically coupled to string 206 may be different than the voltage across an CCE 275 electrically coupled to string 208. For example, LEEs may be based on gallium nitride (GaN) or aluminum indium gallium nitride (AlInGaP), each of which may have different bandgaps. In various embodiments, an additional element may be placed in series with the LEEs to take up excess voltage, for example a resistor or non-light-emitting diode. In various embodiments, the number of LEEs within each string may be different, for example the number of LEEs within a forward-biased string may be different from the number of LEEs within a reverse-biased string, for example to reduce or to eliminate or substantially eliminate the voltage difference between the strings.

Figure 2H:
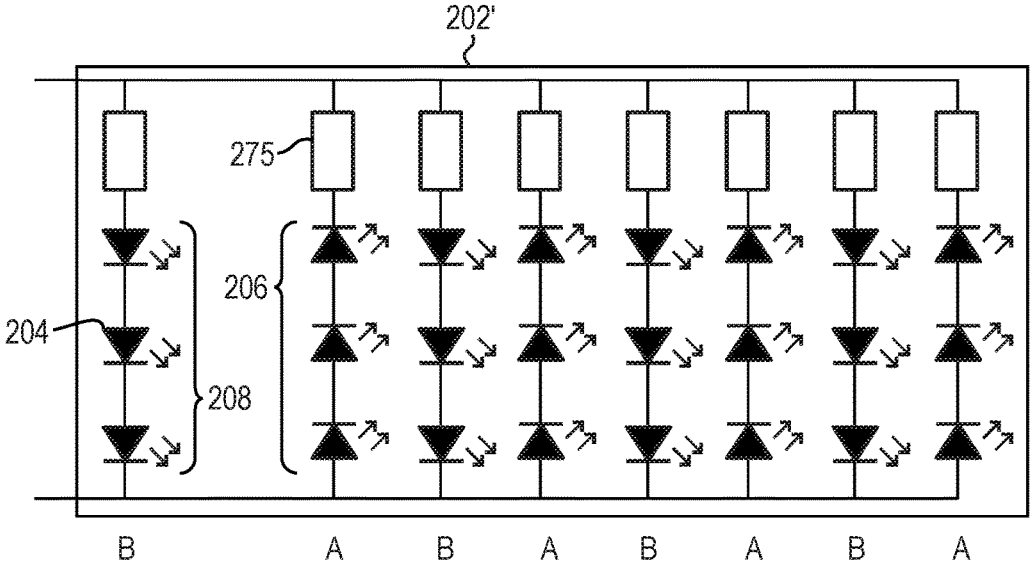
FIG. 2H depicts a partial schematic of a lighting system in accordance with various embodiments of the invention.

While FIGS. 2A and 2G show two strings of LEEs, this is not a limitation of the present invention and in other embodiments, more than two strings of LEEs may be utilized. For example, FIG. 2H shows a schematic of luminaire 202' that includes, consists essentially of, or consists of 4 type-A strings and 4 type-B strings; however, this is not a limitation of the present invention, and in other embodiments luminaire 202' may include, consist essentially of, or consist of a total of about 5 strings, a total of about 20 strings, a total of about 100 strings, a total of about 500 strings, or any arbitrary number of strings of LEEs. While FIG. 2H shows equal numbers of type-A and type-B strings, this is not a limitation of the present invention, and in other embodiments the number of type-A strings may not be equal to the number of type-B strings.

In various embodiments, each of the switches may be a mechanical device, an electromechanical device (for example a relay), a semiconductor device such as a MOSFET, BJT, IGBT, or the like, or any other device capable of opening and closing a conductive electrical path. Herein, all switches (e.g., switch 220) are presumed to operate either substantially instantaneously or with a rapidity that makes their activation times irrelevant to the operational principles discussed. Also, all references to and depictions of two-state switches herein are illustrative, not restrictive: switches having three or more states, as well as replacement of one or more switches by devices permitting a selectable, continuously variable degree of electrical connection, and the various modes of operation made possible by the incorporation of such switches and devices, are also contemplated and within the scope of the invention. Moreover, the systems and luminaires depicted herein (e.g., luminaire 202) may include components not depicted, such as current-regulating devices in series with the LEE strings, light diffusers, breakers, ground lines, and other components. For example, control and power lines to the switches 220, 222, 224, 226 are not depicted in FIG. 2A.

Figure 3A:
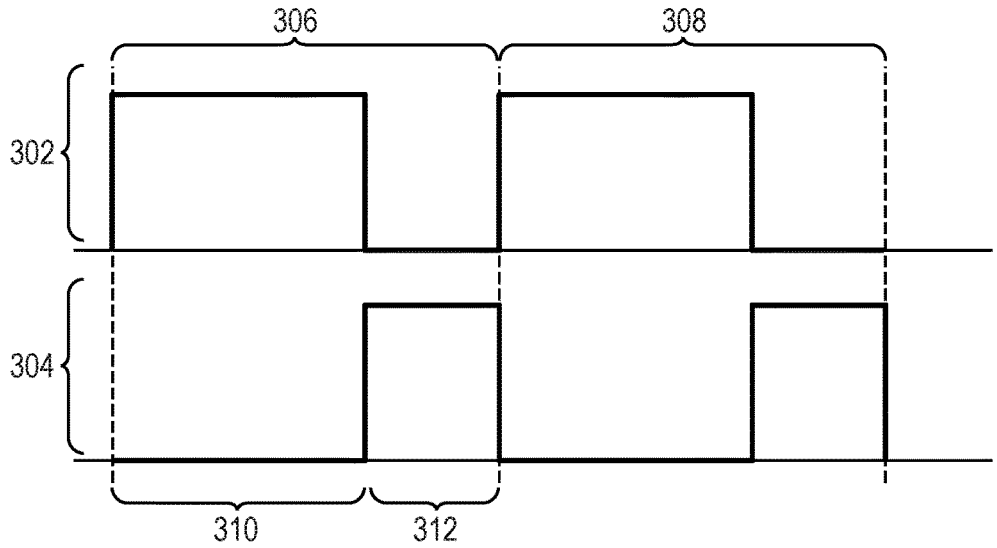
FIG. 3A depicts switch states as a function of time for the system of FIG. 2A to achieve a first color mix.
Figure 3B:
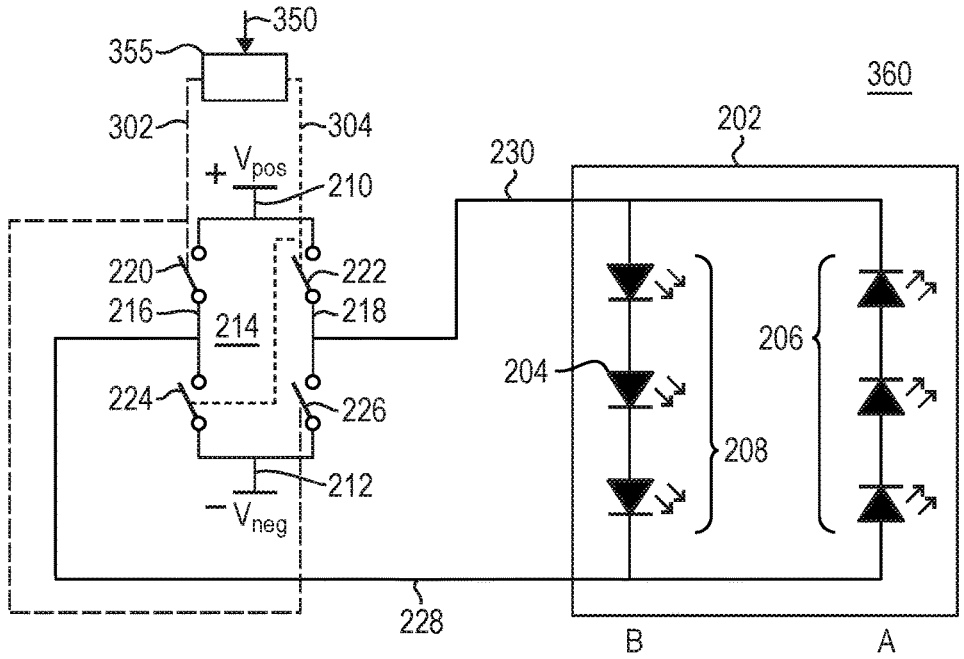
FIG. 3B depicts a schematic of a lighting system in accordance with various embodiments of the invention.

Reference is now made to FIG. 3A, which depicts an illustrative, periodic sequence of states of a pair of control signals 302, 304 for the switches 220, 222, 224, 226 of FIG. 2A. For the plots of the signals 302, 304 the horizontal axis signifies time and the vertical axis signifies Open and Closed, with a low signal signifying Open and a high signal signifying Closed. The first signal 302 controls switches 220 and 226, while the second signal 304 controls switches 222 and 224. Two time intervals 306, 308 are depicted as representative of a periodic series of intervals. The time scale is arbitrary, although preferably the duration of each periodic time interval (e.g., interval 306) is sufficiently short to prevent the perception of flicker by a human observer of the light emitted by the luminaire 202. For example, in various embodiments of the present invention time intervals 306, 308 may be in the range of about 1 millisecond to about 10 milliseconds, or in the range of about 100 microseconds to about 1 millisecond. During a first subinterval 310, the signal 302 controlling switches 220 and 226 is high and the signal 304 controlling switches 222 and 224 is low (i.e., string 206 is On and string 208 is Off). During a second subinterval 312, signal 302 is low and signal 304 is high (i.e., string 206 is Off and string 208 is On). In the notation introduced hereinabove in discussion of FIG. 2A, x~66 and y~34. Since subinterval 310 is approximately twice as long as subinterval 312, extended repetition of the control pattern of interval 306 will cause luminaire 202 to produce illumination having a time-averaged (and thus perceived) spectrum that is weighted toward Color A approximately twice as strongly as toward Color B. As shown in FIG. 3A, signal 302 is the inverse or substantially the inverse of signal 304; in various embodiments of the present invention, a single control signal may be sent to switch array 214 and an inverter or other circuit capable of producing an inverted signal may be incorporated with switch array 214 to provide the regular and inverted signals driving switch array 214. In such embodiments, only one control signal defining the ratio between the On time of the two channels is required. FIG. 3B shows a schematic of a system 360 exemplifying various embodiments of the present invention including input control signal 350 driving inverter 355, resulting in control signals 302 and 304 that drive nodes 216 and 218 of switch array 214. In various embodiments, when incorporating inverter 355, either one of control signal 302 or 304 may be the same or substantially the same as input control signal 350 and the other control signal may be the inverse of input control signal 350. In various embodiments of the present invention, inverter 355 may represent a different form of signal conditioning, for example it may represent a logic algorithm or a microprocessor or the like and may be used to generate one or more control signals from input control signal 350.

Figure 3C:
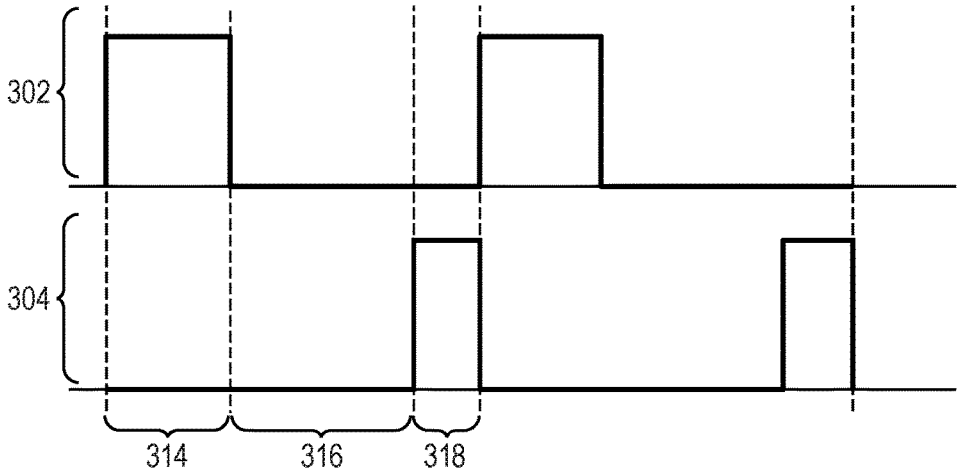
FIG. 3C depicts switch states that dim the color mix of the lighting system of FIG. 3A in accordance with various embodiments of the invention.

Reference is now made to FIG. 3C, which depicts a second illustrative periodic sequence for the control signals 302, 304. The sequence of FIG. 3C produces the same color mix as the sequence of FIG. 3A, but dimmed (i.e., in this case, with about half the time-averaged intensity). During a first subinterval 314, signal 302 is high and signal 304 is low (i.e., string 206 is On and string 208 is Off). During a second subinterval 316, all switches 220, 222, 224, 226 are Open and both strings 206 and 208 are Off. During a third subinterval 318, string 206 is Off and string 208 is On. In the notation introduced in the discussion of FIG. 2A hereinabove, x~34 and y~17. Since x/y~2 for both the control pattern of FIG. 3A and the control pattern of FIG. 3B, the color mix produced by both patterns is the same or substantially the same, but the time-averaged (perceived) brightness of the light produced by the control pattern of FIG. 3C is about half of that produced by the pattern of FIG. 3A. By varying the amount of time both LEE strings 206 and 208 are off (the duration of subinterval 318), and keeping the ratio x/y constant or substantially constant, the brightness of luminaire 202 may be varied while keeping the color constant or substantially constant.

Figure 3D:
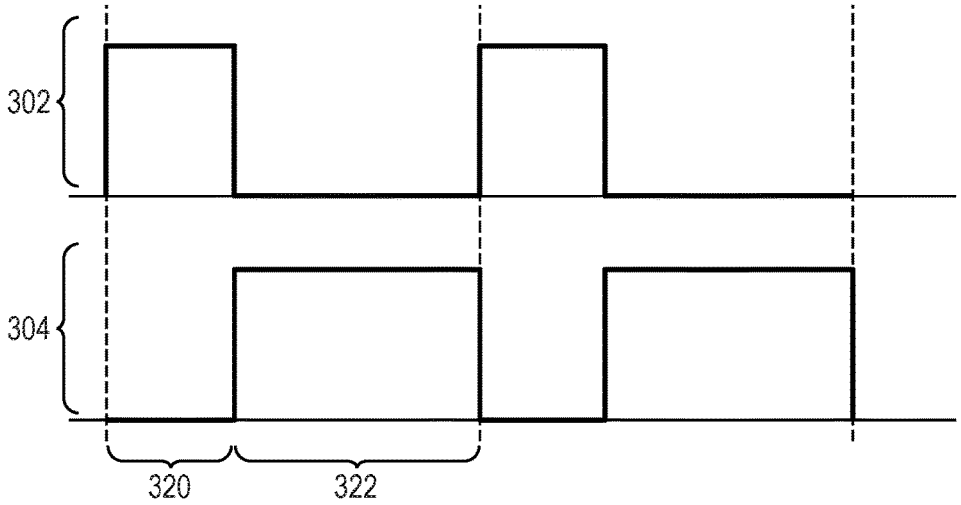
FIG. 3D depicts switch states as a function of time for the system of FIG. 2A to achieve a second color mix in accordance with various embodiments of the invention.

Reference is now made to FIG. 3D, which depicts a third illustrative periodic sequence for the control signals 302, 304. The sequence of FIG. 3D produces a color mix distinct from that of FIG. 3A but of equal or substantially equal brightness. During a first subinterval 320, signal 302 is high and signal 304 is low (i.e., string 206 is On and string 208 is Off). During a second subinterval 322, signal 302 is low and signal 304 is high (i.e., string 206 is Off and string 208 is On). Thus, x~34 and y~66. Since subinterval 322 is approximately twice as long as subinterval 320, this sequence, periodically repeated, will cause the luminaire 202 to produce illumination having a perceived spectrum that is weighted toward Color B approximately twice as strongly as toward Color A.

Figure 3E:
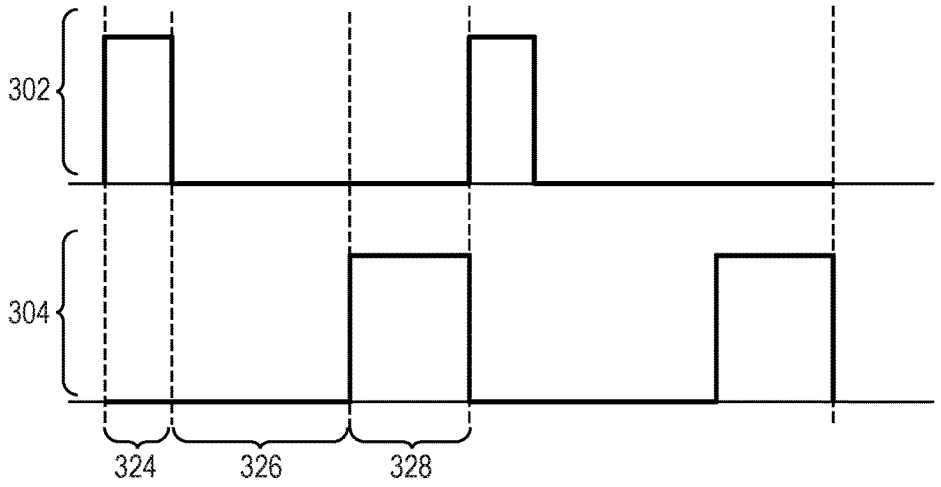
FIG. 3E depicts switch states that dim the color mix of FIG. 3D in accordance with various embodiments of the invention.

Reference is now made to FIG. 3E, which depicts a fourth illustrative periodic sequence for the control signals 302, 304. The sequence of FIG. 3E produces the same color mix as the sequence of FIG. 3D, but dimmed in the same manner, and to approximately the same degree, that the sequence of FIG. 3C produces a dimmed version of the color mix of FIG. 3A. For FIG. 3E, x~17 and y~34. Since x/y~0.5 for both the control pattern of FIG. 3D and the control pattern of FIG. 3E, the color mix produced by both patterns is the same. It will be clear from the examples of FIGS. 3A and 3C-3E that any number of color mixes, at any desired level of dimming, may be produced by varying the control signals 302, 304, provided that LEE strings 206, 208 are switched on and off rapidly enough to prevent the perception of flicker. Persons versed in electrical engineering will recognize that the LEE strings 206, 208 are subjected in the illustrative cases of FIGS. 3A and 3B-3E to a form of pulse-width modulation.

Figure 3F:
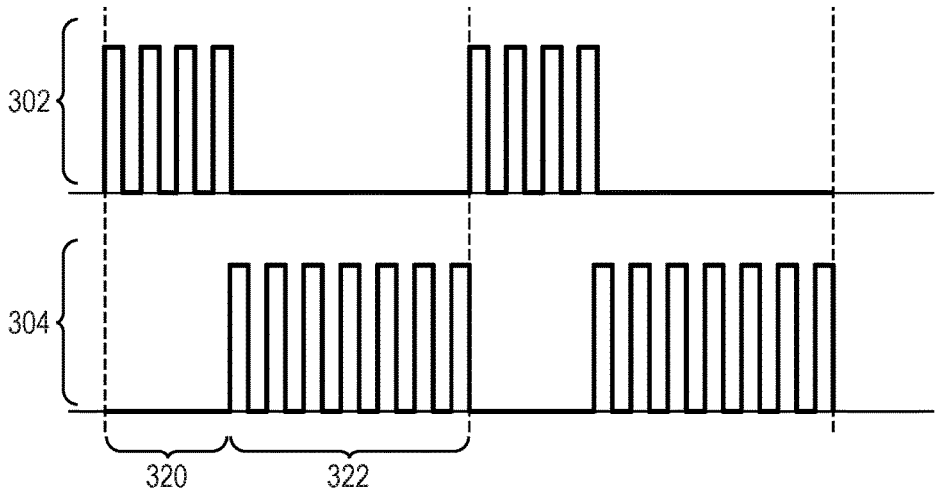
FIG. 3F depicts switch states in accordance with embodiments of the invention.

In various embodiments of the present invention, the power to the switch network may be modulated to provide an additional level of intensity control. For example, FIG. 3F depicts a fifth illustrative periodic sequence for the control signals 302, 304. The sequence of FIG. 3F is similar to that of FIG. 3D, except that within each On period, the power is modulated such that the overall intensity of each group of LEEs is reduced. In various embodiments, the modulation of the power supply may be independent of the switching frequency of the switch network, while in other embodiments it may be synchronized with the switching frequency of the switch network.

Figure 4:
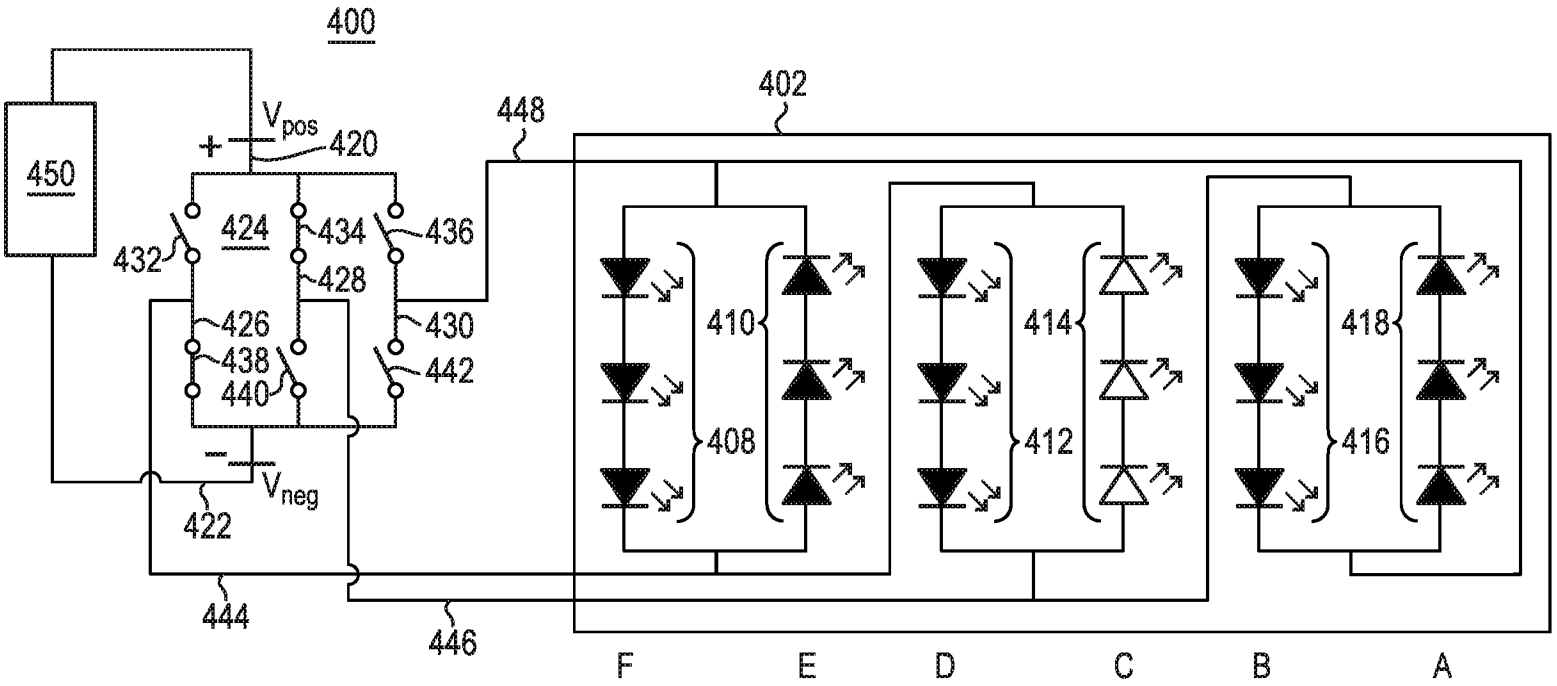
FIG. 4 depicts a lighting system configured for color mixing using six different LEE strings in accordance with various embodiments of the invention.

The number of LEE strings independently controllable by various embodiments of the invention is not limited to two. FIG. 4 schematically depicts portions of an illustrative lighting system 400 in which the brightness and color balance of an LEE luminaire 402 is controlled according to various embodiment of the invention. The luminaire 402 features six LEE strings 408, 410, 412, 414, 416, 418, each of which has a different color (in system 400, colors A, B, C, D, E, and F, respectively). As with FIG. 2A, for simplicity the six strings 408, 410, 412, 414, 416, 418 are presumed to have approximately equivalent electrical properties; however, as discussed herein, this is not a limitation of the present invention, and in other embodiments two or more of the six strings may have different electrical properties.

In the illustrative system 400, a power supply 450 supplies power to terminals 420 and 422 of a switch array 424 that has three nodes 426, 428, 430 and six switches 432, 434, 436, 438, 440, 442. From the first node 426, a first wire 444 runs to the string pairs 408, 410 and 412, 414; from the second node 428, a second wire 446 runs to the string pairs 412, 414 and 416, 418; and from the third node 430, a third wire 448 runs to the string pairs 408, 410 and 416, 418. Given the arrangement of nodes 426, 428, 430 and switches 432, 434, 436, 438, 440, 442, and of the opposing orientations of the paired strings, the switches 432, 434, 436, 438, 440, 442 may be variously opened and closed to achieve seven operational states of system 200, i.e., one Off state (no string lighted) and six states in which a single LEE string is turned On. Table 1 lists switch states utilized to turn each LEE string On:

TABLE 1

Switched control of the six different LEE Strings in FIG. 4.

| STRING TURNED ON | SWITCH 432 | SWITCH 434 | SWITCH 436 | SWITCH 438 | SWITCH 440 | SWITCH 442 |
|---|---|---|---|---|---|---|
| String 408 | OFF | OFF | ON | ON | OFF | OFF |
| String 410 | ON | OFF | OFF | OFF | OFF | ON |
| String 412 | ON | OFF | OFF | OFF | ON | OFF |
| String 414 | OFF | ON | OFF | ON | OFF | OFF |
| String 416 | OFF | ON | OFF | OFF | OFF | ON |
| String 418 | OFF | OFF | ON | OFF | ON | OFF |

By turning individual strings On and Off according to the settings of Table 1, it is straightforward to extend the modulation technique illustrated in FIGS. 3A and 3B-3E from two different color LEE strings or groups to six different color LEE strings or groups. By this technique, the luminaire 402 may be made to produce light of any time-averaged spectrum producible as a weighted mix of the six colors A-F, and of any brightness from zero to the brightness of any single LEE string turned On 100% of the time. Operational states in which switches pairs 432, 438 and/or 434, 440 and/or 436, 442 are simultaneously closed would short the voltage supply and are preferably forbidden states; in various embodiments, mechanical or electronic interlocks (not depicted) within the switch array 424 prevent the occurrence of these states.

The system 400 is advantageous in that it enables the powering and control of six different LEE strings using one fixed-output power supply and three wires; an otherwise equivalent conventional system would require six variable-output power supplies and 12 wires.

It will be clear to a person familiar with circuit design and combinatorics that for embodiments resembling that shown in FIG. 4, but extended from 3 nodes, 3 wires, 6 switches, and 6 LEE strings to N nodes, N wires, 2N switches, and 2N LEE strings, the number C of 2-color LEE string pairs that may be controlled is given by $C=N!/[(N-2)!2]$. FIG. 2A depicts the special case of N=2, C=2, and FIG. 4 depicts the special case of N=3, C=6. In general, it is clear that in various embodiments of the invention, C string pairs may be controlled via N wires (with N corresponding nodes), whereas according to conventional techniques, control of C string pairs would require 4C wires. The wire savings ratio R of various embodiments compared to conventional techniques is therefore $R=4C/N=4N!/[N(N-2)!2]=2(N-1)$. The wire savings ratio R is a linear function of N and for large N, R~2N. In short, the more colors that are controlled, the greater the wire savings ratio.

Similarly, in various embodiments of the invention individual control of C string pairs utilizes only one power supply, whereas according to conventional techniques, control of C string pairs requires 2C power supplies. The power-supply savings ratio P of various embodiments compared to conventional techniques is therefore P=2C/1=2C.

Figure 5:
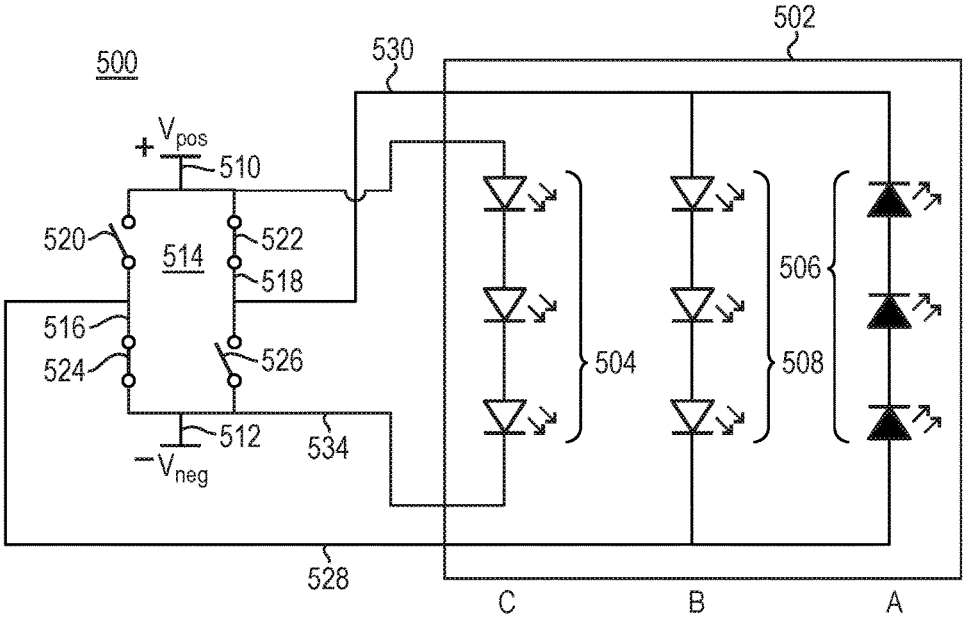
FIG. 5 depicts a lighting system having two switchable LEE strings and one always-on LEE string in accordance with various embodiments of the invention.

Reference is now made to FIG. 5, which schematically depicts portions of an illustrative lighting system 500 in which the brightness and color balance of an LEE luminaire 502 are controlled according to various embodiments of the invention. System 500 features a luminaire 502 that includes three LEE strings 504, 506, 508 that emit light of characteristic colors C, A, and B, respectively. A power supply (not shown in FIG. 5 for clarity) supplies power ($V_{pos}$) at a positive terminal 510 and $V_{neg}$ ($V_{neg}<V_{pos}$) at a negative terminal 512. Between the terminals 510, 512 is a switch array 514 that has two nodes 516, 518 and four switches 520, 522, 524, 526. From the first node 516, a first wire 528 runs to the luminaire 502; from the second node 518, a second wire 530 runs to the luminaire 502. The wires 528, 530 are connected to the LEE strings 506, 508 in a manner similar to that shown and described hereinabove for the LEE strings 206, 208 of FIG. 2A. In FIG. 5, switches 522 and 524 are Closed, causing string 508 to be On. Switch settings that short the power supply may be avoided in various embodiments as described above with reference to FIG. 2A and FIG. 4. The system 500 differs from the system 200 of FIG. 2A in that third and fourth wires 532, 534 run directly from the $V_{pos}$ terminal 510 and $V_{neg}$ terminal 512, respectively, to the third LEE string 504. LEE string 504 is thus always On while power is supplied to system 500, while LEE strings 506, 508 may be switched On and Off as described for strings 206, 208 of FIG. 2A. This arrangement results in constant illumination by string 504 with Color C and switched illumination by Colors A and B.

Figure 6A:
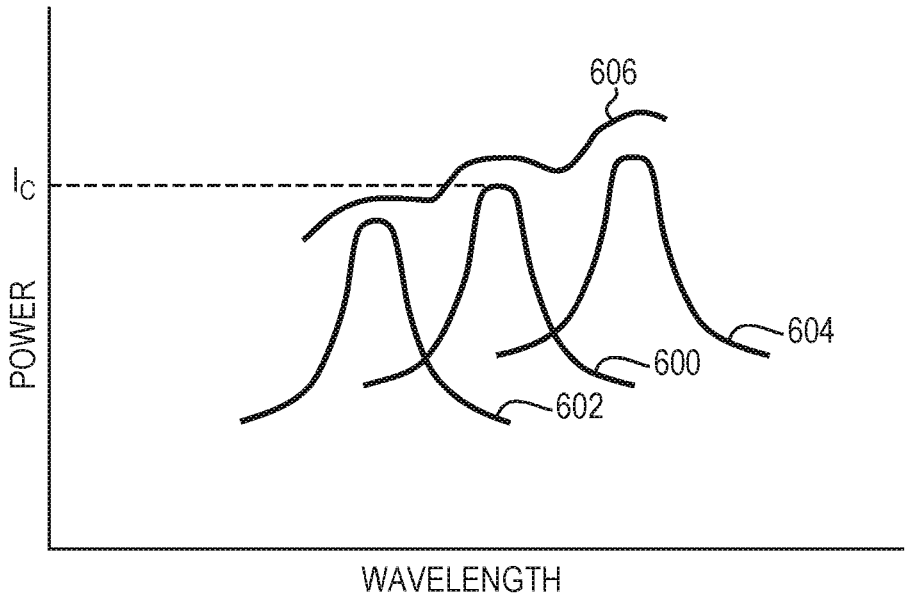
FIG. 6A depicts the spectrum of the light output of the lighting system of FIG. 5 for a first color mix in accordance with various embodiments of the invention.
Figure 6B:
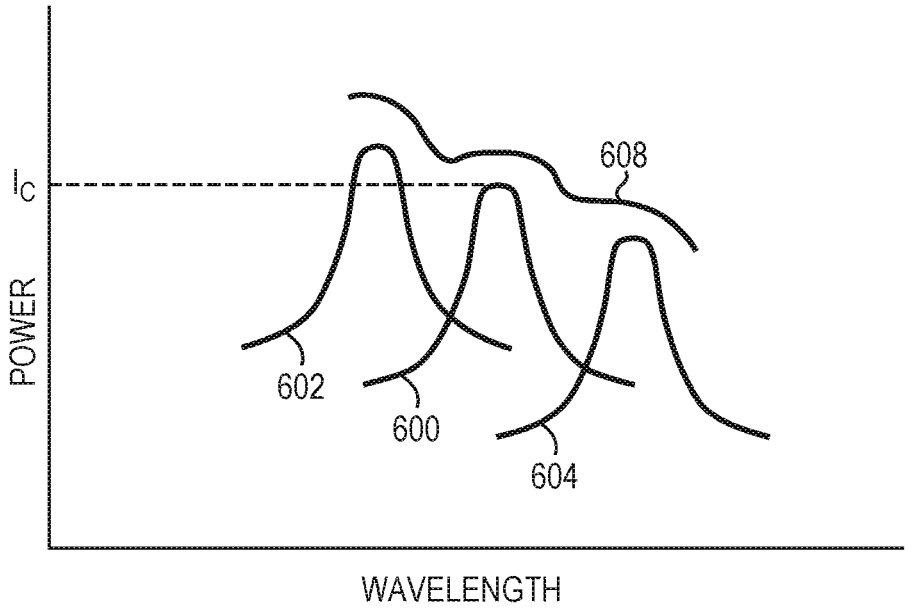
FIG. 6B depicts the spectrum of the light output of the lighting system of FIG. 5 for a second color mix in accordance with various embodiments of the invention.

FIG. 6A and FIG. 6B conceptually depict time-averaged spectra of light emitted by the luminaire 502 of FIG. 5 in two modes of operation of the system 500. The spectrum 600 is emitted by string 504 (Color C), the spectrum 602 is emitted by string 506 (Color A), and the spectrum 604 is emitted by string 508 (Color B). The peak of spectrum 600 is at a fixed or substantially fixed amplitude $I_C$.

In FIG. 6A, string 506 (Color A, spectrum 602) is periodically switched on and off (i.e., operated with an appropriate duty cycle) to produce illumination whose time-averaged spectrum has a peak power lower than $I_C$, while string 508 (Color B, spectrum 604) is operated with an appropriate duty cycle) to produce illumination whose spectrum has a peak time-averaged power higher than $I_C$. The resulting summed time-averaged (perceived) spectrum 606 is thus weighted toward higher wavelengths (i.e., is more red).

In FIG. 6B, string 506 (Color A, spectrum 602) is operated with an appropriate duty cycle to produce illumination whose spectrum has a peak time-averaged power higher than $I_C$, while string 508 (Color B, spectrum 604) is operated with an appropriate duty cycle to produce illumination whose spectrum has a peak time-averaged power lower than $I_C$. The resulting summed, time-averaged spectrum 608 is thus weighted toward lower wavelengths (i.e., is more blue). It will be clear that any number of other weightings of the three spectra 600, 602, 604 may be produced by appropriate switching (duty cycling) of the controllable strings 506, 508 of FIG. 5. In various other embodiments, a variable power supply may be supplied to terminals 510, 512, allowing for control of string 504 as well as of strings 506 and 508. For example, modulation of the power supplied to terminals 510, 512 may permit modulation of the intensity of the overall system, while variation of the duty cycle may permit changing the color.

System 500 is advantageous in that it permits three-color spectral shaping (color mixing) using one power supply and four wires, whereas an otherwise equivalent system built according to conventional techniques would require three power supplies and six wires.

Figure 7:
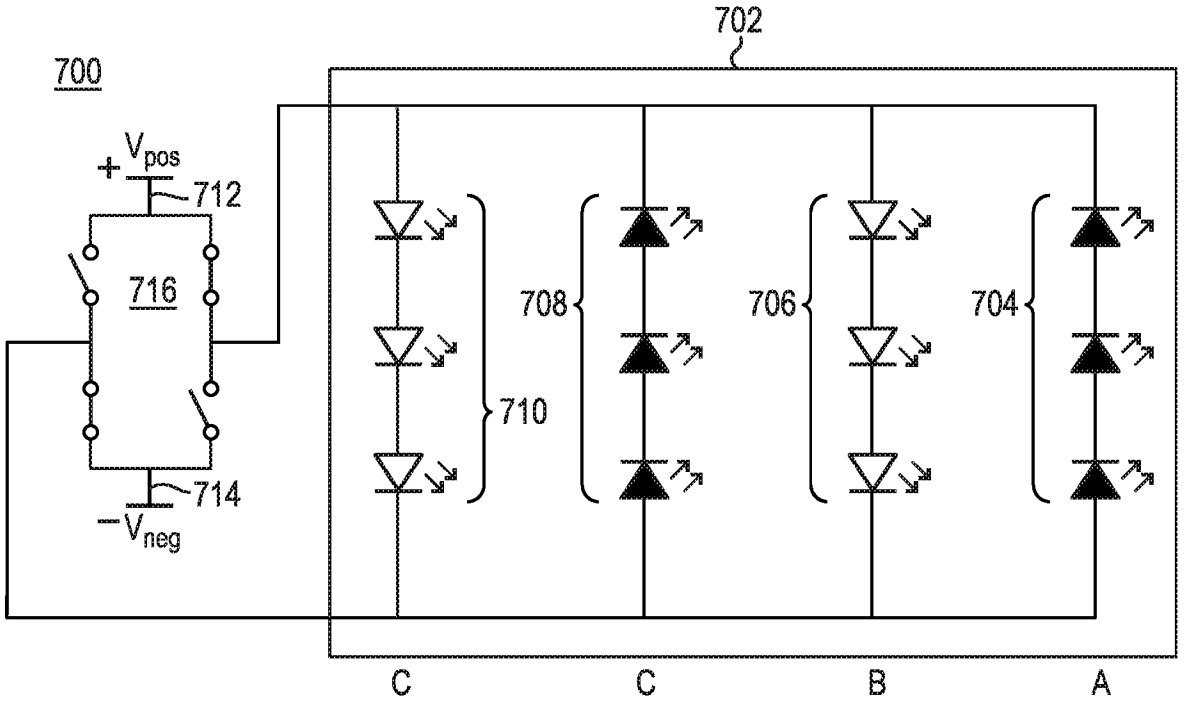
FIG. 7 depicts a lighting system having four switchable LEE strings in accordance with various embodiments of the invention.

Reference is now made to FIG. 7, which schematically depicts portions of an illustrative lighting system 700 in which the brightness and color mix of an LEE luminaire 702 are controlled according to various embodiments of the invention. System 700 features a luminaire 702 that includes four LEE strings 704, 706, 708, 710 that emit light of characteristic colors A, B, C, and C, respectively. A power supply (not shown) supplies power to a terminal 712 and to a terminal 714. Between the terminals 712, 714 is a switch array 716 similar to that shown and described hereinabove with reference to switch array 214 of FIG. 2A and switch array 514 of FIG. 5. The notable difference between system 700 and system 200 of FIG. 2A is that, given the orientation of the LEE strings 704, 706, 708, 710, either string 708 or string 710 is On whenever either string 704 or string 706 is On. Therefore, the Color C spectrum is present in any light emitted by the luminaire 702. In the time-averaged spectrum of light emitted by the luminaire 702, the weighting of Color C will thus be intermediate between the weighting accorded to Color A and the weighting accorded to Color C. System 700 is advantageous in that it permits three-color spectral shaping (color mixing) using one power supply and two wires, whereas an otherwise equivalent system built according to conventional techniques would require three power supplies and six wires.

Figure 8A:
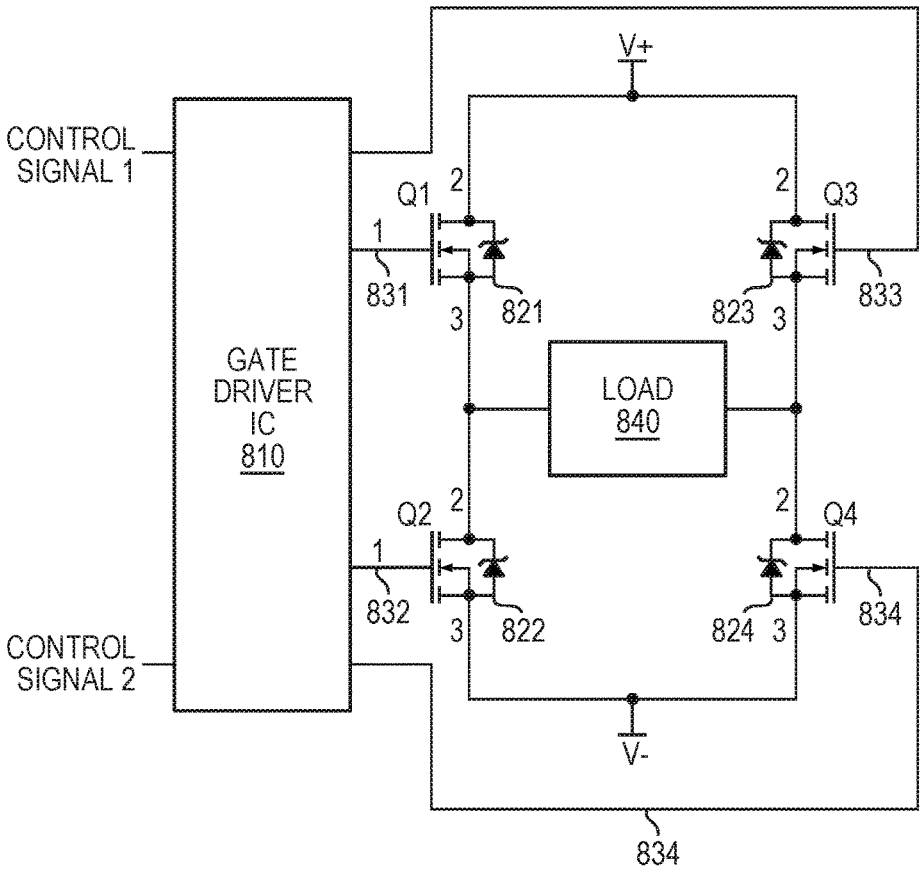
FIGS. 8A-8C depict various circuits for lighting systems in accordance with various embodiments of the invention.

FIG. 8A shows an exemplary H-Bridge circuit in accordance with various embodiments of the present invention, including, consisting essentially of, or consisting of four N-channel MOSFETs 821-824 (also identified as Q1-Q4) as the switches, and a control integrated circuit (IC) 810 to provide the gate control signals 831-834 to MOSFETs 821-824 respectively. While control IC 810 of FIG. 8A is shown as a single integrated circuit, this is not a limitation of the present invention, and in other embodiments the control IC may include, consist essentially of, or consist of more than one integrated circuit, a circuit including, consisting essentially of, or consisting of one or more discrete components, a combination of one or more integrated circuits and one or more discrete components, or any other circuit.

In various embodiments of the present invention, control signal 831 will turn on MOSFET switches 821 (Q1) and 824 (Q4), forcing the current to flow through load 840 from left to right, and control signal 832 will turn on MOSFET switches 822 (Q2) and 823 (Q3), forcing the current to flow from right to left through load 840. In order to prevent short circuits, circuitry inside the Control IC 810 prevents Switches Q1 and Q2, and/or Q3 and Q4 being ON simultaneously, as known in the art and as discussed herein.

Figure 8B:
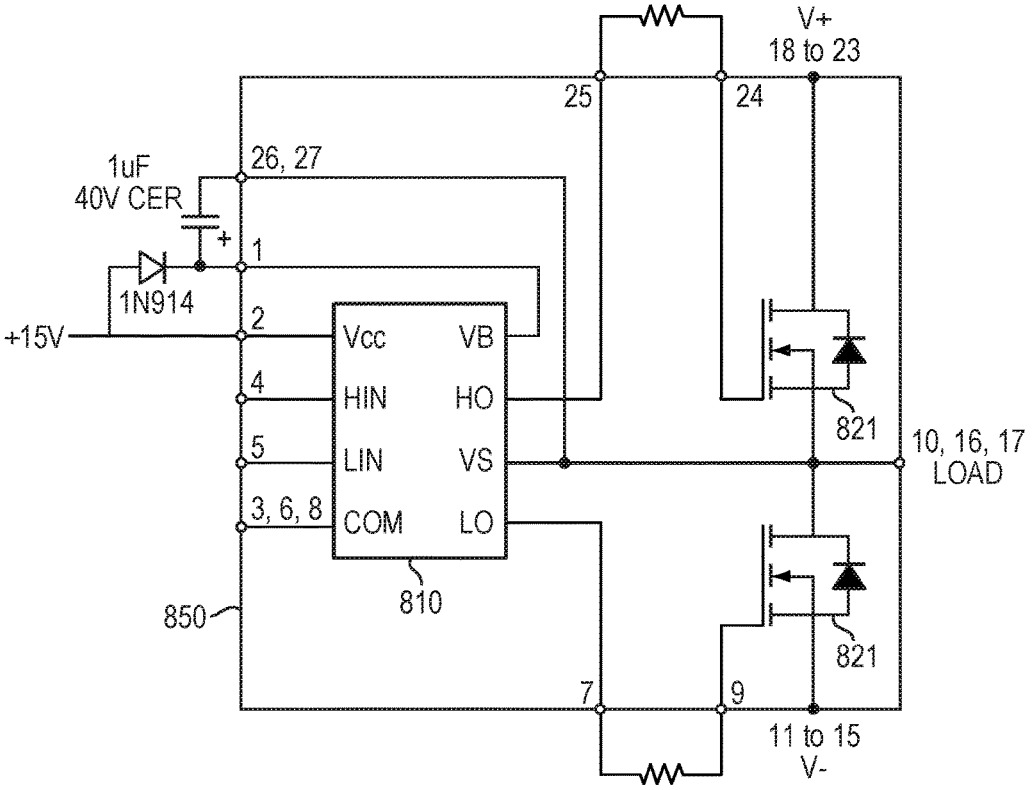

In various embodiments of the present invention, two MOSFETs and the control IC may be incorporated into one IC, for example the IRSM005-301MH manufactured by International Rectifier, now Infineon. This IC then forms a "Half Bridge." FIG. 8B shows an exemplary Half Bridge 850 in accordance with various embodiments of the present invention. Typically, two Half Bridges are utilized to form one H Bridge. While the example in FIG. 8B includes, consists essentially of, or consists of a Half Bridge IC IRSM005-301MH manufactured by International Rectifier/Infineon, this is shown as an exemplary IC and other similar ICs may be used, as understood by those skilled in the art.

Figure 8C:
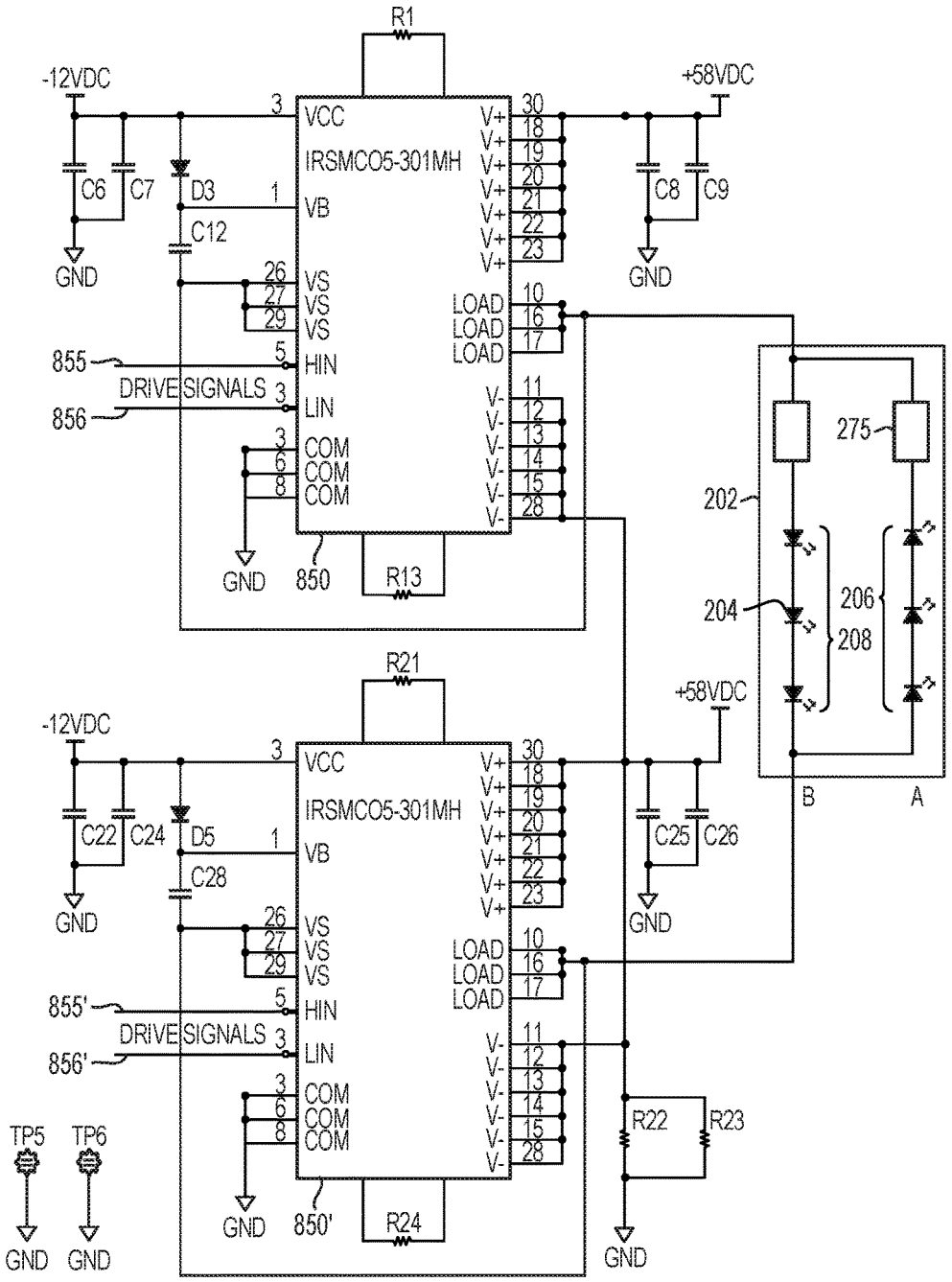

FIG. 8C shows an exemplary lighting system in accordance with embodiments of the present invention, including, consisting essentially of, or consisting of two Half Bridge ICs 850 and 850'. The two Half Bridge ICs 850 and 850' drive lighting system 202, as described in reference to FIG. 2G. In various embodiments of the present invention drive signals 855, 856, 855', and 856' may be provided by a control system, for example a micro-controller, a microprocessor, a computer, a logic circuit or other control mechanism or means, to switch the current direction to cause either string A or string B to emit light. In various embodiments, drive signals 855 and 855' may be electrically coupled together and driven by the same control signal and/or drive signals 856 and 856' may be electrically coupled together and driven by the same control signal.

FIG. 8D shows an exemplary schematic of a control system of the present invention, including, consisting essentially of, or consisting of two Half Bridges U2 and U3 (each Half Bridge being similar to or the same as Half Bridge 850 in FIG. 8A) and a microcontroller U1. In various embodiments of the present invention, the circuit of FIG. 8D controls the currents flowing in a load connected to J3 and including two or more antiparallel strings or groups of LEEs (not shown for clarity in FIG. 8D).

The Load currents are controlled by two separate 0 to 10 VDC analog signals. In this circuit they are called RATIO and DIM and are present on connector J2. The RATIO signal controls the mix [RATIO] between the load currents for the two antiparallel strings of LEEs, and DIM controls the overall light level.

The signals are fed to microcontroller U1 where the amplitudes are measured, interpreted by software, and converted into four drive signals (Hin and Lin for U2, and Hin and Lin for U3).

Referring to Half Bridge 850 in FIG. 8B, in various embodiments of the present invention a positive signal on Hin will turn the uppermost MOSFET on, while a positive signal on Lin will turn the lowermost MOSFET on. Both MOSFETs are typically never turned on simultaneously, as this would place a short circuit across the power supply.

As described herein, two Half Bridge Drivers are utilized to make one Full Bridge, also called an H-Bridge Driver. The two Half Bridges are shown in the circuit of FIG. 8D as U2 and U3.

When the microcontroller determines that current should flow through the load in the forward direction, it sends a drive signal to Hin of U2 and Lin of U3 (Lin of U2, and Hin of U3 are held off during this period.) This turns the uppermost MOSFET of U2 ON, and the lowermost MOSFET of U3 ON. While these MOSFETs are ON, current flows from the positive supply, out at pin 1 of J3, through the load and back in at pin 2 of J3, and to Ground.

To turn on the other series of LEEs of the antiparallel load, current is flowed in the opposite direction through the load. The microcontroller now turns off the previous MOSFETs by removing their drive signals, and sends a drive signal to Lin of U2 and Hin of U3. While these MOSFETs are ON, current flows from the positive supply, out at pin 2 of J3, through the load and back in at pin 1 of J3, and to Ground. Current is now flowing through the load in the reverse direction.

By forcing currents of varying pulse widths, and direction, through the load (e.g., a luminaire), independent control of the light output intensity each of the antiparallel strings of LEEs, as well as the overall intensity of the combined LEE load, is achieved. As described herein, in various embodiments of the present invention the antiparallel strings or groups of LEEs may have different colors, permitting mixing or tuning of the perceived color of the lighting system; however, this is not a limitation of the present invention, and in other embodiments the anti-parallel strings or groups of LEEs may have other differences, for example optical differences such as CCT, color point, CRI, R9, spectral power distribution, spatial intensity distribution or the like, and varying the current to each of the anti-parallel groups or strings may permit variation or tuning of these characteristics, for example between the optical characteristics of those of each anti-parallel string of LEEs operating individually.

As discussed herein, switch arrays of the present invention may be configured to control more than two groups of LEEs, for example in reference to the system of FIG. 5, and such switch arrays may be used to vary or tune one or more optical parameters between three or more characteristics of each group or string of LEEs operating individually. Herein, the term "luminaire" may describe an enclosure surrounding a group or array of LEEs; however, it is to be understood that the term luminaire, as used herein, may represent an arbitrary lighting system, whether enclosed in a single enclosure or not. While the lighting systems have been described in terms of luminaires, it is to be understood that embodiments of the present invention may also be utilized on a light emitter or LEE (e.g., LED) level. For example, various embodiments of the present invention may include a package containing multiple LEDs in groups that are in reverse-bias and forward-bias configurations, such that an optical characteristic, for example color or CCT, produced by the package may be varied by the means described herein.

While embodiments of the present invention have been described in terms of adjustment and control of the color of illumination systems, for example the CCT or color point, this is not a limitation of the present invention, and in various embodiments the different branches, that have been described as having different colors, may have different characteristics, for example color rendering index (CRI), R9, spectral power distribution, intensity, spatial intensity distribution, or the like. For example, systems in accordance with embodiments of the present invention may be utilized to control the spatial intensity distribution, for example using a first branch having a first spatial intensity distribution and a second branch having a second spatial intensity distribution, different from the first. In various embodiments, such a system may provide a variable spatial intensity distribution lighting system, for example varying from a collimated beam to beam having a wide spatial intensity distribution.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A method of operating, over a plurality of time intervals, an illumination system comprising (i) only a single power supply, (ii) one or more first strings of light-emitting elements, and (iii) one or more second strings of light-emitting elements, different from the one or more first strings, wherein the first and second strings are configured to emit light of different optical characteristics, the method comprising:

(A) during a first time interval within the plurality of time intervals, (i) forward biasing the one or more first strings by supplying thereto a first signal from the power supply, and (ii) reverse biasing the one or more second strings;

(B) during a second time interval after the first time interval, disconnecting the one or more first strings from the power supply and disconnecting the one or more second strings from the power supply;

(C) during a third time interval after the second time interval, (i) forward biasing the one or more second strings by supplying thereto a second signal from the power supply, and (ii) reverse biasing the one or more first strings;

(D) repeating (A)-(C) one or more times;

during step (D), varying a perceived overall optical characteristic of light emitted by the illumination system over the plurality of time intervals by varying relative durations of the first and third time intervals; and during step (D), decreasing an overall intensity of light emitted by the illumination system over the plurality of time intervals by increasing a duration of the second time interval, wherein an amplitude of the first signal is equal to an amplitude of the second signal.

2. The method of claim 1, wherein the illumination system comprises one or more third strings of light-emitting elements different from the first and second strings, further comprising (i) during step (A), forward biasing the one or more third strings by supplying thereto a third signal from the power supply, and (ii) during step (C), forward biasing the one or more third strings by supplying thereto the third signal from the power supply, an amplitude of the third signal being equal to the amplitudes of the first and second signals.

3. The method of claim 1, wherein the overall optical characteristic is varied and the overall intensity is decreased via operation of two or more switches within a switch array.

4. The method of claim 3, wherein (i) the switch array comprises 2N switches, and (ii) the plurality of strings comprises 2C strings, C being equal to N!/[(N−2)!2].

5. The method of claim 3, wherein the strings are connected to the power supply by a plurality of wires, a number of the wires being approximately one-half of a number of switches within the switch array.

6. The method of claim 3, wherein each of the switches comprises a mechanical switch, a relay, or a transistor.

7. The method of claim 3, wherein the switch array comprises an H-bridge circuit.

8. The method of claim 3, wherein the switch array comprises at least two half-bridge circuits.

9. The method of claim 1, wherein the overall optical characteristic comprises at least one of color, color point, correlated color temperature, color rendering index, R9, spectral power distribution, or spatial intensity distribution.

10. The method of claim 1, wherein (i) the one or more first strings comprise a plurality of first strings, and/or (ii) the one or more second strings comprise a plurality of second strings.

11. The method of claim 1, wherein each of the first strings and each of the second strings comprises at least five light-emitting elements.

12. The method of claim 1, wherein:

the one or more first strings comprise a plurality of strings, wherein (i) each of the first strings comprises two or more light-emitting elements, (ii) the first strings are electrically coupled together in parallel, and (iii) each of the first strings has a first polarity; and the one or more second strings comprise a plurality of strings, wherein (i) each of the second strings comprises two or more light-emitting elements, (ii) the second strings are electrically coupled together in parallel, and (iii) each of the second strings has a second polarity different from the first polarity.

13. The method of claim 1, wherein the time intervals proceed at a frequency between 500 Hz and 10 kHz.

14. The method of claim 1, wherein the first strings and the second strings are configured to emit light of different colors, color points, correlated color temperatures, color rendering indices, R9s, spectral power distributions, intensities, and/or spatial intensity distributions.

15. The method of claim 1, wherein the time intervals range in duration from approximately 1 millisecond to approximately 10 milliseconds.

16. The method of claim 1, wherein the time intervals range in duration from approximately 100 microseconds to approximately 1 millisecond.

17. The method of claim 1, wherein the first and second signals supplied from the power supply are current signals.

18. The method of claim 1, wherein the first and second signals supplied from the power supply are voltage signals.

* * * * *